US010163295B2

(12) United States Patent
Miura

(10) Patent No.: US 10,163,295 B2
(45) Date of Patent: Dec. 25, 2018

(54) GAMING MACHINE, GAMING MACHINE CONTROL METHOD, AND GAMING MACHINE PROGRAM FOR GENERATING 3D SOUND ASSOCIATED WITH DISPLAYED ELEMENTS

(71) Applicant: Konami Gaming, Inc., Las Vegas, NV (US)

(72) Inventor: Norikazu Miura, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 225 days.

(21) Appl. No.: 14/849,475

(22) Filed: Sep. 9, 2015

(65) Prior Publication Data

US 2016/0092156 A1 Mar. 31, 2016

Related U.S. Application Data

(60) Provisional application No. 62/055,118, filed on Sep. 25, 2014.

(51) Int. Cl.
*A63F 9/24* (2006.01)
*G07F 17/32* (2006.01)
(Continued)

(52) U.S. Cl.
CPC ..... *G07F 17/3213* (2013.01); *G07F 17/3202* (2013.01); *G07F 17/323* (2013.01);
(Continued)

(58) Field of Classification Search
CPC ..... G07F 17/3202; G07F 17/3213; G07F 17/3216; G07F 17/3223; G07F 17/323;
(Continued)

(56) References Cited

U.S. PATENT DOCUMENTS 6,950,524 B2 9/2005 Nelson et al.
8,096,869 B2 1/2012 Yoshimi
(Continued)

FOREIGN PATENT DOCUMENTS

JP 2001079264 A2 9/1999
JP 2003159381 A2 6/2003
JP 2003199935 A2 7/2003

OTHER PUBLICATIONS

Notice of Reasons for Rejection with English Translation (JP Appln. No. P2015-184171); dated Nov. 15, 2016.
(Continued)

*Primary Examiner* — Justin Myhr
(74) *Attorney, Agent, or Firm* — Howard & Howard Attorneys PLLC

(57) ABSTRACT

A gaming machine for providing a game to a player is described herein. The gaming machine includes a housing, a sound reproduction system coupled to the housing, a display device, and a gaming controller. The sound reproduction system is configured to generate sound features associated with the game and to emit 3D sound effects within a listening space associated with the gaming machine. The gaming controller randomly determines an outcome of the game and display the outcome on the display device, detects a triggering condition occurring in the outcome of the game, and determines a game feature in response to detecting the triggering condition and causes the sound reproduction system to generate a sound feature including a 3D sound effect traveling along a sound path orientated with respect to a listening reference point defined within the listening space to facilitate simulating a game element moving within the listening space.

20 Claims, 25 Drawing Sheets

(51) Int. Cl.
*H04R 1/02* (2006.01)
*H04S 7/00* (2006.01)

(52) U.S. Cl.
CPC ..... *G07F 17/3216* (2013.01); *G07F 17/3223* (2013.01); *G07F 17/3267* (2013.01); *H04R 1/028* (2013.01); *H04S 7/30* (2013.01); *A63F 2300/6063* (2013.01); *H04S 2400/11* (2013.01); *H04S 2400/13* (2013.01)

(58) Field of Classification Search
CPC . G07F 17/3267; H04R 1/028; H04S 2400/11; H04S 2400/13; H04S 7/30
See application file for complete search history.

(56) References Cited

U.S. PATENT DOCUMENTS 8,249,263 B2 * 8/2012 Cragun ..... G06T 19/00 345/184
8,628,402 B2 1/2014 Nakamura
2002/0025849 A1 * 2/2002 Olive ..... G07F 17/3244 463/29
2004/0142747 A1 * 7/2004 Pryzby ..... G07F 17/32 463/35
2005/0222844 A1 * 10/2005 Kawahara ..... H04S 3/002 704/260
2008/0113756 A1 * 5/2008 Williams ..... G07F 17/3211 463/20
2009/0298579 A1 * 12/2009 Radek ..... G07F 17/32 463/25
2010/0062827 A1 * 3/2010 Hoffman ..... G07F 17/34 463/20
2010/0331072 A1 * 12/2010 Wiryadi ..... G07F 17/34 463/20
2011/0045905 A1 * 2/2011 Radek ..... G07F 17/32 463/31
2013/0143638 A1 6/2013 Nakamura

OTHER PUBLICATIONS

JP Notice of Reasons for Rejection with English Translation (JP Patent Application No. 2015-184171); dated May 9, 2017; 7 pages.

* cited by examiner

70

| 71 | 72 | 73 | 74 | 75 |
|---|---|---|---|---|
| Q | Pic-D | Pic-E | Pic-D | A |
| Pic-A | J | 10 | A | Pic-A |
| J | A | Q | A | Pic-B |
| K | Q | K | A | K |
| A | K | Pic-C | J | Scatter |
| A | Pic-E | J | 9 | 10 |
| A | Pic-B | Pic-D | Pic-A | Pic-E |
| Pic-E | Pic-A | Scatter | 10 | 9 |
| Wild | Wild | A | K | J |
| Pic-B | 10 | Pic-B | Pic-E | Wild |
| Scatter | Scatter | Wild | Scatter | 9 |
| Pic-D | 10 | Wild | Pic-C | Q |
| 10 | 9 | Wild | Wild | 10 |
| 9 | Pic-C | 9 | Q | Pic-C |
| Pic-C | 9 | Pic-A | Pic-B | Pic-D |
| Q | J | 10 | K | A |
| Q | J | 10 | K | A |
| Q | J | 10 | K | A |
| Pic-C | Pic-A | Pic-A | Pic-A | Pic-A |
| Pic-D | Pic-A | Pic-A | Pic-B | Pic-B |

60

150

FIG. 4A

| | | | | | | | | | | | | |
|---|---|---|---|---|---|---|---|---|---|---|---|---|
| 9 | 10 | J | Q | K | A | Pic-E | Pic-D | Pic-C | Pic-B | Pic-A | Wild | Scatter |

FIG. 4B

FIG. 23
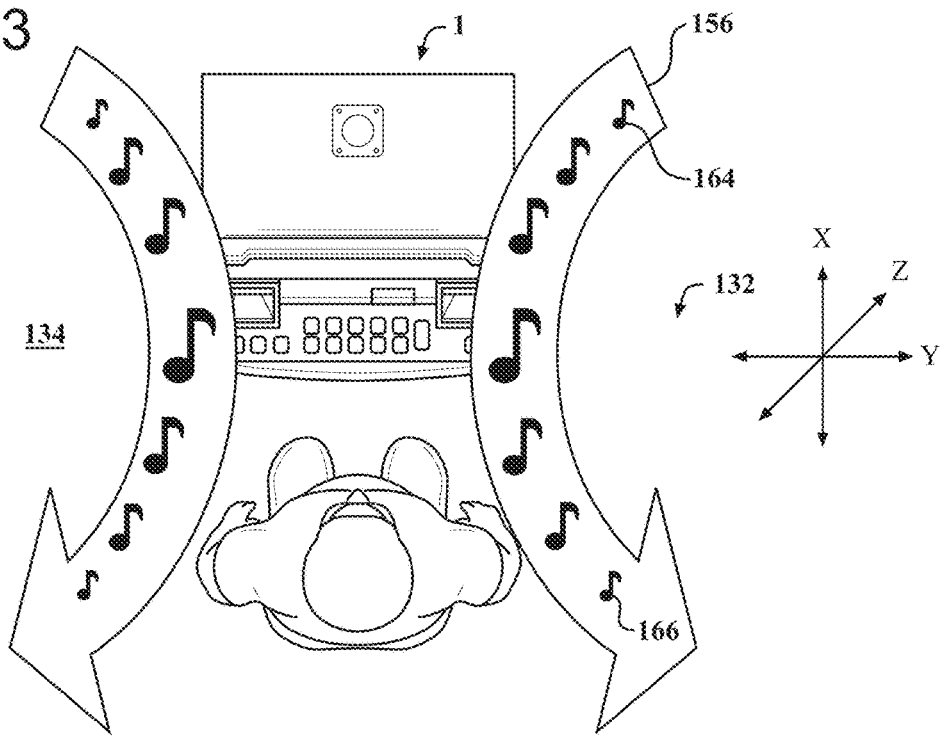
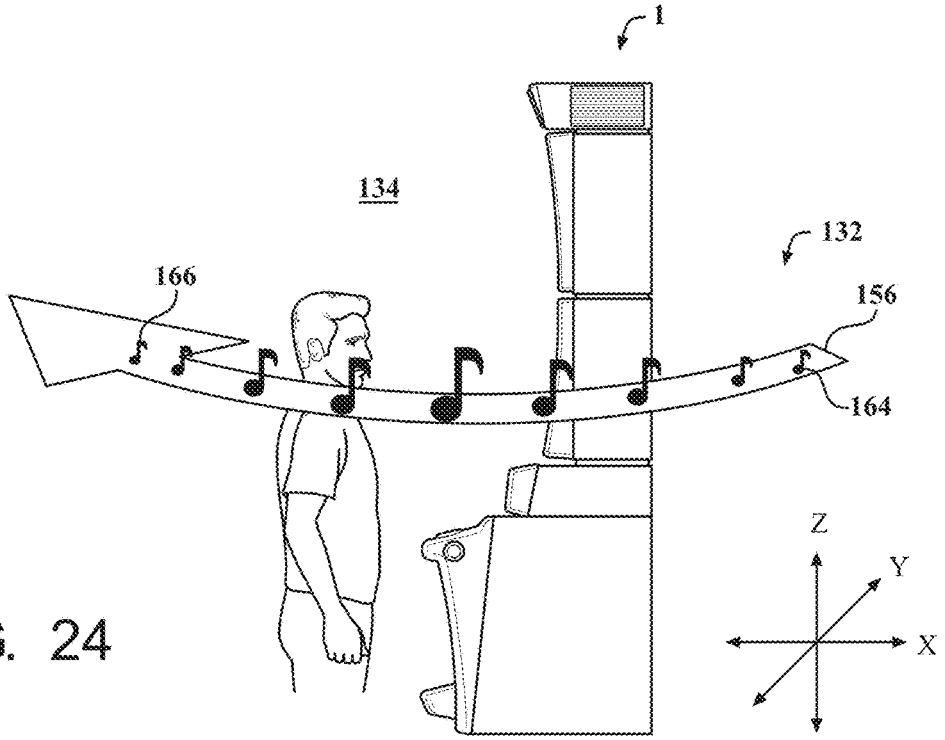
FIG. 24

| | 132 Game Feature | 170 Sound Effect | 156 Sound Path | 140 Symbol Display Effect |
|---|---|---|---|---|
| 168 | A | Dragon Rumble | SP A | Dragon Bonus Reel |
| 168 | B | Stack Rumble | SP B | Stack of Symbols |
| 168 | C | Bonus Chime | SP C | Bonus Symbol |

FIG. 27

172

| | 162 Source Location | 176 X, Y, Z Coordinate | 178 Time Interval | 180 Frequency, Hz | 182 Decibel Level, dB |
|---|---|---|---|---|---|
| 174 | Origination | 5, 3, 0 | 1 sec | 150 | 5 |
| 174 | Point 1 | 3, 1, 0 | 3 sec | 200 | 6 |
| 174 | Point 2 | 0, 1, 0 | 5 sec | 250 | 7 |
| 174 | Destination | -3, 3, 0 | 6 sec | 200 | 6 |

FIG. 28

GAMING MACHINE, GAMING MACHINE CONTROL METHOD, AND GAMING MACHINE PROGRAM FOR GENERATING 3D SOUND ASSOCIATED WITH DISPLAYED ELEMENTS

CROSS-REFERENCE TO RELATED APPLICATION

This application claims priority to U.S. Provisional Patent Application Ser. No. 62/055,118, filed Sep. 25, 2014, the disclosure of which is hereby incorporated by reference in its entirety.

TECHNICAL FIELD

The present invention relates to a gaming machine, gaming machine control method, and gaming machine program.

BACKGROUND ART

Gaming machines represented by a slot machine are very popular among guests in casinos as a machine that allows a person to enjoy gambling simply, and it has been statistically reported in recent years that revenue by gaming machines account for half or more of the sales in casinos. Early slot machines were simple machines that accepted coins to spin and stop a reel mechanically configured in accordance with a handle operation to determine a win or loss of by a combination of symbols stopped on a single pay line. However, gaming machines in recent years have advanced in sophistication into a variety of gaming machines including mechanical slot machines that drive a physical reel with high precision using a stepping motor controlled by a computer, video slot machines that display a virtual reel on the display connected to a computer, and similar techniques applicable to other casino games. To the manufacturers developing these gaming machines, providing an attractive game that can actively draw in casino guests as players is a critical theme to improving functionality of gaming machines.

In consideration of this background, recent gaming machines configured to increase the interest of the player in the game by staging and processing colorful effects into images displayed on a display unit is becoming more common. For example, Patent Document 1 discloses a gaming machine that provides an expensive prize to the player by having a dragon character displayed on the display unit transport an additional wild symbol.

DOCUMENTS OF THE RELATED ART

Patent Document #1: U.S. Pat. No. 8,628,402.

SUMMARY OF INVENTION

As in the gaming machine described in Patent Document 1, visual recognition by the player of a staging process displayed on the display unit is an effective method for increasing interest in the game in the player. However, staging having a novel mode that is beyond the display of the display unit is required to provide the player so that the player can have an increased interest at a higher dimension.

In light of the above situation, various aspects of the present invention are to provide a gaming machine, and a gaming machine control method, that can provide to a player staging having a novel mode that is beyond display on the display unit.

An aspect of the present invention, to resolve the above problem, is to provide a gaming machine, that includes an operation unit that accepts an operation of a player; a display unit that displays a plurality of symbols in a determination region having a plurality of rows and a plurality of columns; a sound providing unit that rumbles sound oriented in a predetermined position; and a control unit, connected to the operation unit and the display unit, that varies and stops the plurality of symbols displayed on the display unit according to the accepted operation of the player by the operation unit and grants an award according to a symbol stopped in the determination region; wherein the control unit, when a feature function that grants an additional symbol to the symbol in the determination region is triggered, determines a mode of the additional symbol, causes a sound oriented in a predetermined position to rumble in the sound providing unit at a timing in accordance with the mode of the additional symbol, causes the additional symbol to appear in the display unit adding to the symbol in the determination region.

Further, another aspect of the present invention is to provide a gaming machine control method that includes an operation unit that accepts an operation of a player; a display unit that displays a plurality of symbols in a determination region having a plurality of rows and a plurality of columns; a sound providing unit that rumbles sound oriented in a predetermined position; and a control unit, connected to the operation unit and the display unit, that varies and stops the plurality of symbols displayed on the display unit according to the accepted operation of the player by the operation unit and grants an award according to a symbol stopped in the determination region; wherein the method comprises a step for the control unit to trigger a feature function that grants an additional symbol to a symbol in the determining region, a step for the control unit to determine a mode of the additional symbol, a step for the control unit to cause a sound oriented in a predetermined position to rumble in the sound providing unit at a timing in accordance with the determined mode of the additional symbol, and a step for the control unit to cause the additional symbol to appear in the display unit added to the symbol in the determination region.

In an aspect of the present invention, the control unit may further cause an oriented sound to rumble in the sound providing unit so as to move on a path from the predetermined position to arrive at the display unit. The control unit, after causing a sound oriented in the predetermined position to rumble in the sound providing unit, causes an oriented sound to rumble in the sound providing unit so as to move on a path from the predetermined position to arrive at the display device. The control unit may also select one path from a plurality of paths to arrive at the display unit from the predetermined position and causes an oriented sound to rumble in the sound providing unit so as to move on a selected path.

In one aspect of the present invention, a gaming machine for providing a game to a player is provided. The gaming machine includes a housing, a sound reproduction system coupled to the housing, a display device, a plurality of input devices, a gaming controller, and at least one memory device storing a plurality of gaming machine instructions accessible by the gaming controller. The sound reproduction system is configured to generate sound features associated with the game and to emit 3-Dimensional (3D) sound effects within a listening space associated with the gaming machine. The gaming controller is configured to allow the player to make a wager on the game and adjust the credit balance by an amount of the wager, randomly determine an outcome of the game and display the outcome on the display device, detect a triggering condition occurring in the outcome of the game, and determine a game feature in response to detecting the triggering condition and cause the sound reproduction system to generate a sound feature including a 3D sound effect traveling along a sound path orientated with respect to a listening reference point defined within the listening space to facilitate simulating a game element moving within the listening space.

In another aspect of the present invention, a computer-implement method for providing a game to a player with a gaming machine is provided. The gaming machine includes a housing, a sound reproduction system, a display device, a plurality of input devices, and a gaming controller. The method includes allowing the player to make a wager on the game and adjusting the credit balance by an amount of the wager. The gaming controller randomly determines an outcome of the game and displays the outcome on the display device. The gaming controller detects a triggering condition occurring in the outcome of the game, and determines a game feature in response to detecting the triggering condition and causes the sound reproduction system to generate a sound feature including a 3D sound effect traveling along a sound path orientated with respect to a listening reference point defined within a listening space associated with the gaming machine to facilitate simulating a game element moving within the listening space.

In a further aspect of the present invention, one or more non-transitory computer-readable storage media, having computer-executable instructions embodied thereon is provided. The computer-executable instructions cause the processor to receive a signal indicating a wager being placed by a player on a game and adjust a credit balance associated with the player by an amount of the wager. The processor randomly determines an outcome of the game and displays the outcome on a display device, detects a triggering condition occurring in the outcome of the game, and determines a game feature in response to detecting the triggering condition and causes a sound reproduction system to generate a sound feature. The sound reproduction system is coupled to a gaming machine housing and is configured to generate 3D sound effects within a listening space associated with the gaming machine. The sound feature includes a 3D sound effect traveling along a sound path orientated with respect to a listening reference point defined within a listening space associated with the gaming machine to facilitate simulating a game element moving within the listening space.

With the various aspects of the present invention, a gaming machine that can provide a player with staging having a novel mode that is beyond the display of the display unit, a gaming machine control method, and a gaming machine program are provided.

BRIEF DESCRIPTION OF DRAWINGS

FIGS. 4A and 4B are configuration diagrams of a reel strip.

FIGS. 21-26 are schematic diagrams illustrating game features that may be implemented by the gaming machine shown in FIG. 1, according to an embodiment of the present invention; and FIGS. 27 and 28 are exemplary illustrations of data records that may be used by the gaming machine shown in FIG. 1, according to an embodiment of the present invention.

Corresponding reference characters indicate corresponding parts throughout the drawings.

DESCRIPTION OF EMBODIMENTS

Figure 1:
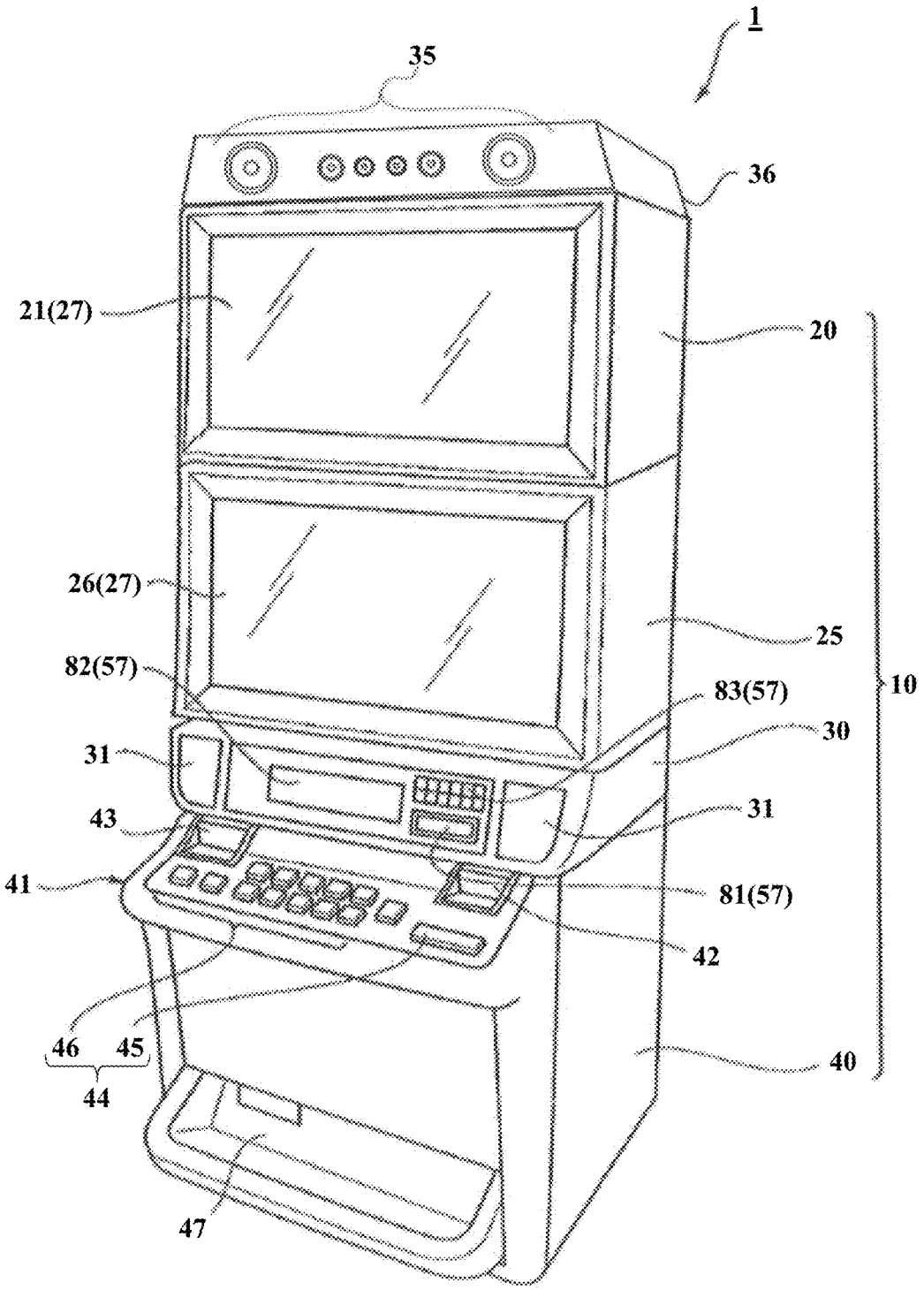
FIG. 1 is a diagram illustrating a configuration of a gaming machine according to one embodiment of the present invention.

A gaming machine according to an embodiment of the present invention will be described hereinafter in detail with reference to attached drawings. Note that, the same reference numerals are given to the same or equivalent part in each drawing, and redundant descriptions will be omitted.

The gaming machine according to the present embodiment accepts a predetermined game participation value from a player to generate a game result, and a payout is provided to the player in accordance with the game result. FIG. 1 is a perspective view of a gaming machine 1 according to the present embodiment. As illustrated in FIG. 1, the gaming machine 1 has a speaker cabinet 36 that has 3D enabled speakers 35 enabled with 3D sound and a housing 10 that is configured with a first cabinet 20 provided with an upper part display 21, a second cabinet 25 provided with a lower part display 26, a third cabinet 30 that has a player tracking unit 57, and a fourth cabinet 40 that has a control unit 50 with a control panel 41 to control each part. Each configuration will be described below.

The speaker cabinet 36 provided at the uppermost part of a casing 15 has a 3D enabled speaker 35 enabled with 3D sound. Here, the 3D sound refers to a technique to sterically reproduce a sound environment, and provides a three-dimensional sound field control system that produces sound as if the sound source is placed at a designated position in a room. In the present embodiment, a two-channel 3D enabled speaker 35 disposed according to the OPSODIS system (see U.S. Pat. No. 6,950,524) is mounted in the speaker cabinet 36, and the speaker cabinet 36 is integrally configured with the casing 15. Therefore, there is no need to provide an additional speaker outside of the casing 15, and it is able to utilize the 3D sound by a simple configuration. The gaming machine 1 of the present embodiment having such configuration provides 3D sound by a crosstalk cancellation technology that controls the position for sound orientation using mutual interference of sound entering from the right and left ears of a player by the control unit 50 driving the 3D enabled speaker 35 based on the predetermined sound data. The sound data for providing 3D sound can be obtained, for example, by converting the sound data oriented to a predetermined position by surround mixing to a binaural system.

The first cabinet 20 is provided on an upper part of the housing 10, and the second cabinet 25 is provided under the first cabinet 20. Both the upper part display 21 provided in the first cabinet 20 and the lower part display 26 provided in the second cabinet 25 are a flat panel display device such as a liquid crystal display device or an organic EL display device, and each functions as a display unit 27 that provides a player a game screen, which will be described later, and are each controlled by the control unit 50.

The third cabinet 30 is provided under the second cabinet 25. Speakers 31, provided on the right and left of the front face of the third cabinet 30, are controlled by the control unit 50 to provide a normal dual-channel stereo sound or monaural sound to a player. Note that, a description is given in the present embodiment of when the 3D enabled speaker 35 and the speaker 31 are provided separately; however, both may be combined as a single sound source unit. Further, a player tracking unit 57 is housed in the center of the front face of the third cabinet 30. The player tracking unit 57 has a card reader 81 that identifies a player identification card, a display 82 that presents information to the player, and a keypad 83 that accepts input by the player. Such player tracking unit 57 reads the information recorded on the player identification card by the control unit 50, or by a cooperative operation with an external system to be described hereinafter, when inserted into the card reader 81 by the player and displays the information, or information obtained by communicating with the external system, on the display 82 Also, it accepts input from the player by the keypad 83, changes the display of the display 82 in accordance with the input, and communicates with the external system if necessary.

The fourth cabinet 40 is disposed under the third cabinet 30. A control panel 41 is provided in the fourth cabinet 40 so that a portion thereof is projected frontward. A paper money/ticket identification unit 42, printer unit 43, and an operation unit 44 are provided on the control panel 41.

The paper money/ticket identification unit 42 is disposed in the control panel 41 such that the insertion slot where the paper money or ticket is inserted is exposed, an identification unit that identifies the paper money/ticket by various sensors is provided behind the insertion slot, and a paper money/ticket retention unit is provided at the identification unit exit side inside the fourth cabinet 40. The paper money/ticket identification unit 42 accepts and identifies paper money and tickets (including vouchers and coupons) of a game participation value as a price to play the game and notifies the control unit 50 described later.

The printer unit 43 is disposed in the control panel 41 such that the ticket exit slot where the ticket is output is exposed, a printing unit that prints predetermined information onto a printing sheet is provided behind the ticket exit slot, and a stowing unit where the printing sheet is stowed is provided on the sheet insertion side of the printing unit. The printer unit 43 prints the information corresponding to the credit payout processing from the gaming machine 1 and outputs the ticket under the control of the control unit 50 described later. The output ticket may be used for game play using the credit paid out by inserting the paper money/ticket identification unit of another gaming machine, or it may be exchanged for cash in a kiosk terminal or casino cage in the casino.

An operation unit 44 accepts operations of the player. The operation unit 44 is a button group to accept a variety of instructions from the player into the gaming machine 1. The operation unit 44 has, for example, a spin button 45 and a setting button group 46. The spin button 45 accepts instruction for starting a game described below (start rotation of a reel). The setting button group 46 includes a bet button group, a line designation button group, a max bet button, a payout button, and the like. The bet button group accepts an instruction operation from the player for a credit amount (a number of bets) for betting. The line designation button group accepts an instruction operation from the player that designates a payline (hereinafter referred to as a valid line) to be subject for line determination to be described later. The max bet button accepts an instruction operation from the player for a bet of the maximum credit amount that is allowed to bet at one time. The payout button accepts an instruction operation from the player designating payout of the credit accumulated in the gaming machine 1.

Further, a control board having built-in a central processing unit (hereinafter, abbreviated to CPU) 51 making up the control unit 50, an interface unit 52, a memory 53, a storage 54, and the like, is mounted in the fourth cabinet 40. The control board is configured so as to communicate with each of the configuration elements mounted in the first cabinet 20, second cabinet 25, third cabinet 30 and fourth cabinet 40 via the interface unit 52, control each unit by executing the program recorded in the memory 53 or the storage 54 by the CPU 51, and provide a game to the player.

Figure 2:
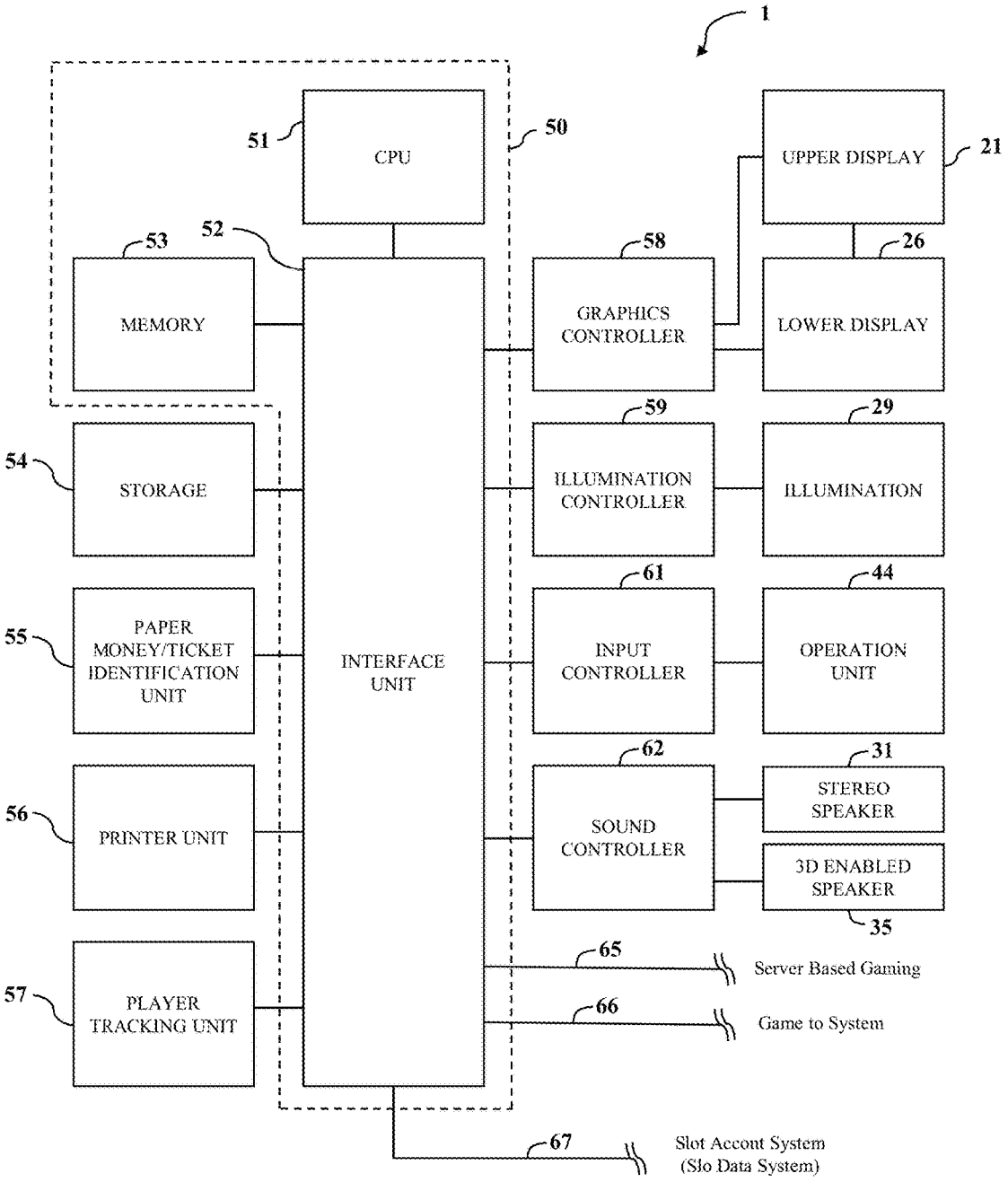
FIG. 2 is a functional block diagram of a gaming machine shown in FIG. 1.

FIG. 2 illustrates a functional block diagram of the gaming machine 1 according to the present embodiment. The gaming machine 1 is provided with a control unit 50. The control unit 50 is configured as a computer unit provided with a CPU 51, an interface unit 52 including a chip set that provides communication functions such as a memory bus, a variety of expansion buses, a serial, USB, Ethernet (registered trademark), and the like that are connected to the CPU, a memory 53 where the CPU 51 can be accessible via the interface unit 52, and a storage 54. The memory 53 may be configured with RAM that is a volatile storage medium, ROM that is a non-volatile storage medium, and EEPROM that is a rewritable non-volatile storage medium. The storage 54 provides a function to the control unit 50 as an external storage device, may use a reading device such as a memory card, a magnetic optical disk, or the like that is a removable storage medium, and may also use a hard disk.

Paper money/ticket identification unit 55, printer unit 56, player tracking unit 57, graphic controller 58, input controller 61 and sound controller 62 are connected to the interface unit 52 besides the CPU 51, memory 53, and storage 54.

That is, the control unit 50 is connected to the operation unit 44 via the input controller 61 and connected to the upper part display 21 and/or the lower part display 26 via the graphic controller 58. Note that, when illumination is provided for producing decorative lightings to the gaming machine 1, an illumination controller 59 that provides decorative illumination effects by controlling the illumination under the control of the control unit 50, may be connected to the interface unit 52.

The control unit 50 having the memory 53 and the storage 54 as described above controls each of the units by executing a program stored in the memory 53 and storage 54 to provide a game for a player. Here, a configuration may even be designed, for example, so that programs and data of the operating system and sub system that provides the basic function of the control unit 50 are stored in EEPROM of the memory 53, and programs and data of the application that provide a game are stored in the storage 54. With such configuration, switching or updating games can be easily performed by exchanging the storage 54. Note that, the control unit 50 may have a multi-processor configuration having a plurality of CPUs.

Next, each block connected to the control unit 50 will be described.

The paper money/ticket identification unit 55 corresponds to the paper money/ticket identification unit 42 described above, and is a unit to notifies the control unit 50 information after identifying information corresponding to a type of paper money or credit payout process by accepting the paper money or ticket in the insertion slot. When the paper money/ticket identification unit 55 notifies the information to the control unit 50, the control unit 50 increases a credit amount that is usable for a game according to the notified content. The printer unit 56 corresponds to the printer unit 43 described above, and puts out a ticket where the information corresponding to the credit payout process from the gaming machine 1 is printed under the control of the control unit 50 that has accepted the payout button operation of the setting button group 46 described above.

The player tracking unit 57 sends and receives the player information with a casino management system of a player by having a cooperative operation with the control unit 50. The graphic controller 58 displays a display image including various graphic data by controlling the upper part display 21 and the lower part display 26 under the control of the control unit 50.

A sound controller 62 drives the speaker 31 under the control of the control unit 50 to provide various sounds such as announcements, sound effects, BGM, and the like. The speaker 31 and the 3D enabled speaker 35 are connected to the sound controller 62 in the present embodiment, stereo or monaural sound is provided by driving the speaker 31, and also 3D sound is provided by driving the 3D enabled speaker.

Further, the interface unit 52 has a variety of communication interfaces to communicate an external unit of the gaming machine 1, and for example, it is able to communicate with an external network by Ethernets 86, 87, and serial output 88. The present embodiment illustrates a communication with a known server-side gaming network (Server Based Gaming in FIG. 2), a G2S network (Game to System in FIG. 2), and a slot information system (Slot Data System in FIG. 2), respectively.

Figure 3:
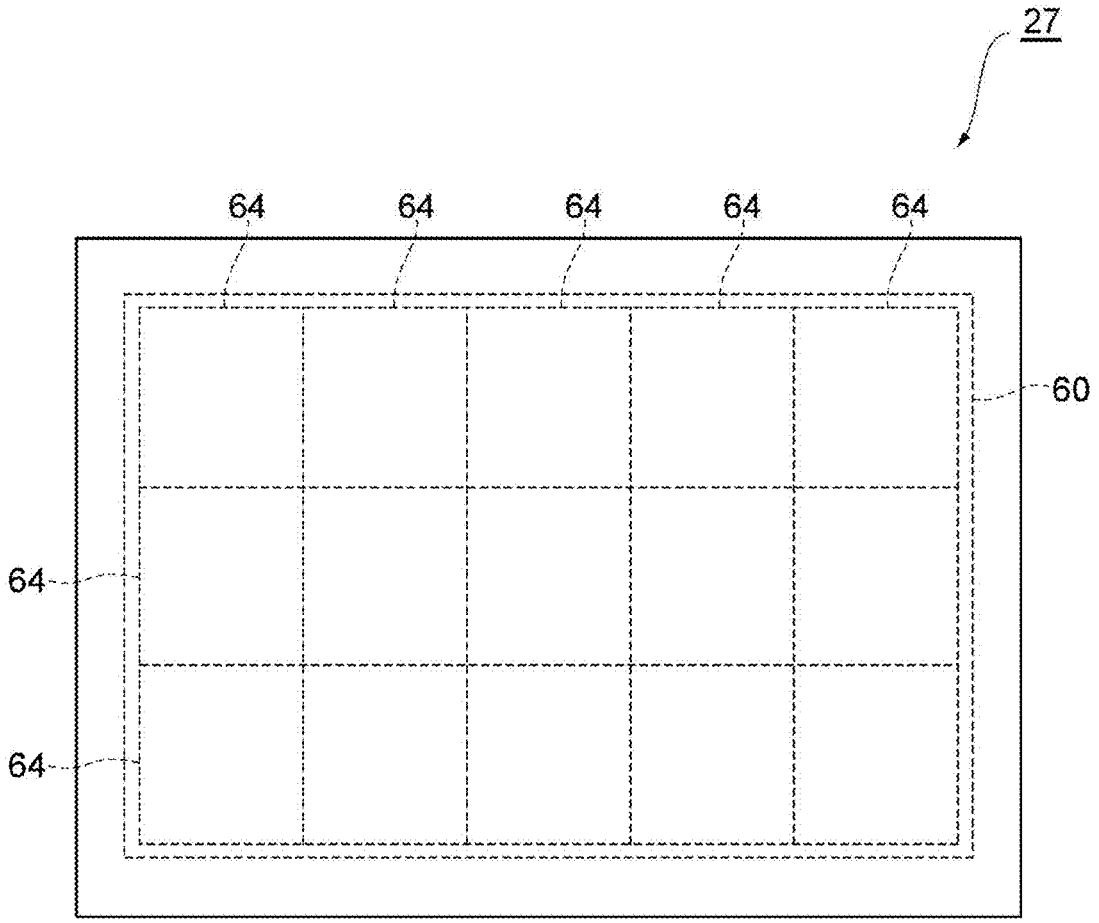
FIG. 3 is a diagram showing main parts of a game screen provided by the gaming machine.

FIG. 3 is a schematic diagram of a substantial part of a game screen provided by the gaming machine 1 according to the present embodiment. Such game screen is displayed on the display unit 27 (the upper part display 21 and/or the lower part display 26) by the control unit 50 executing a predetermined program. The present embodiment shows a mode where the game screen is displayed on the lower part display 26. As illustrated in FIG. 3, this game screen has a determination region for displaying symbols. The gaming machine 1 of the present embodiment operates as a slot machine to pay the payout according to a prize combination of symbols displayed on the determination region by using such game screen.

The display unit 27 displays a plurality of symbols on the determination region having a plurality of columns and a plurality of rows. The determination region 60 is configured of a plurality of cells 64 that is a stop position of a symbol. More specifically, the determination region 60 is configured of 15 cells arranged in a lattice form of 3 rows and 5 columns. Note that, besides the determination region 60, a region where a credit amount, a number of bets, a credit amount obtained by winning a prize (number of WINs), and decorative region may be displayed in the display unit 27 although they are omitted in FIG. 3. One symbol is stopped and displayed in each of the plurality of cells 64 of the determination region 60.

A predetermined symbol is displayed in each of the cells 64 of the determination region 60 based on the symbol sequence of virtual reel strips 71 to 75 that compose a virtual reel set 70 as illustrated in FIG. 4A. That is, the virtual reel strips 71 to 75 correspond to each column in the cell 64 of the determination region 60, and a symbol arranged in the predetermined section of each of the virtual reel strips 71 to 75 is displayed. Further, the symbols displayed in the cells in the determination region 60 vary by moving (scrolling) the symbols with respect to each column based on the symbol sequence of the virtual reel strips 71 to 75 as will be described below, and symbols stop by stopping the movement (scrolling) with respect to each column. Here, the virtual reel strips 71 to 75 refer to data used in the program that is held in the memory 53 and the storage 54 by the control unit 50, and data for showing the prescribed symbol sequence (i.e., the order of symbols of each reel) in each column of the cells. Further, the virtual reel set 70 is a collective term of such virtual reel strips 71 to 75.

Each of the virtual reel strips 71 to 75 is configured with 20 symbols in the example of FIG. 4A, and those symbols are arranged in a defined order in each reel. FIG. 4B is a diagram illustrating symbols individually shown in FIG. 4A. Each of the virtual reel strips 71 to 75 includes a symbol selected from 13 types of symbols set shown in FIG. 4B. This symbol set includes card symbols simulating playing cards ("9", "10", "J", "Q", "K", "A") as normal symbols, and picture symbols illustrating a design ("PIC-a", "PIC-b", "PIC-c", "PIC-d", "PIC-e"). This symbol set further includes, as special symbols, a wild symbol ("Wild") substituting for another symbol upon a winning determination and a scatter symbol ("Scatter") used in prize determination of the special game. Each of these symbols has a different rank from one another on a winning value, and the rank increases gradually in order of "9", "10", "J", "Q", "K", "A", "PIC-e", "PIC-d", "PIC-c", "PIC-b", "PIC-a". A combination of symbols containing a high rank at the time of winning can obtain a higher valued winning payout compared to a symbol combination when winning with lower rank.

The control unit 50 that has started the game determines a stop position randomly for each of the virtual reel strips 71 to 75, and expresses the action where the virtual reel strips 71 to 75 are moved from the current position and stopped at the stop position, by using the display unit 27 (e.g., the lower part display 26). Accordingly, symbols contained in the virtual reel strips 71 to 75 moves sequentially (scrolls) in the vertical direction of the determination region 60 and stops so that one symbol is displayed in one cell 64.

The control unit 50 varies and stops a plurality of symbols displayed in the display unit 27 according to the acceptance of the operation by a player by the operation unit 44, and pays the payout in accordance with the symbols stopped in the determination region 60.

Figure 5:
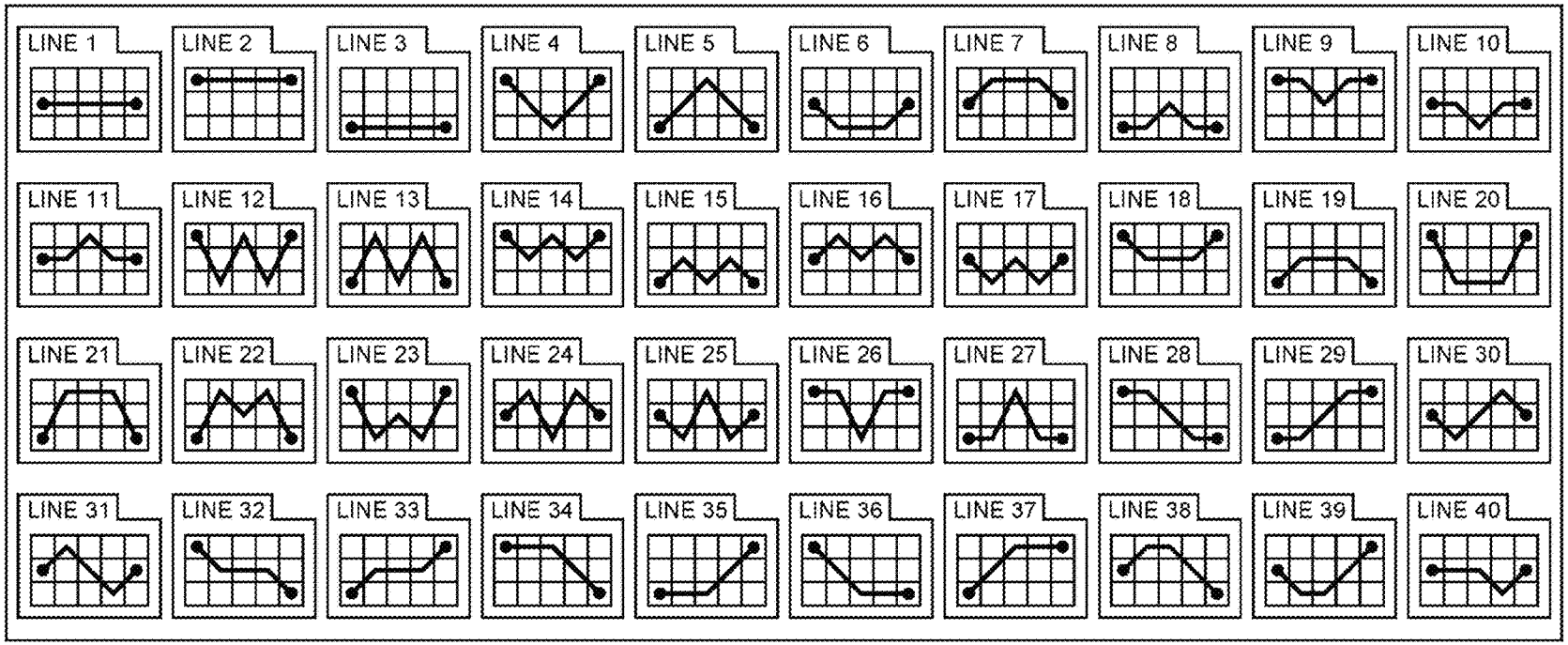
FIG. 5 is a diagram showing a pay line.

In the determination region 60, a pay line used upon a winning determination is set. The pay line is set so as to straddle from the left end column to the right end column, and a line of the combination of the plurality of cells 64 that is a subject to be a winning determination. A number of effective lines within the set pay lines is selected by an operation of the line designation button group included in the set button group 46 of the player operation unit 44. The control unit 50 determines a combination of symbols that is a game result, for example, it determines winning when the identical symbol are lined up beyond the predetermined number on the set pay line and pays the player the payout according to a type and number of symbols. In the gaming machine 1 according to the present embodiment, a predetermined number of pay lines (LINES 1 to 40) are set for a 3-rows and 5-columns cell of the determination region 60 (see FIG. 5). A method of the winning determination may be varied, and it may determine a win when a predetermined number of identical symbols are lined up on the predetermined pay line from the left end column cell, or when a determined number of identical symbols are lined up on the predetermined line from the right end column cell, or even when a predetermined number of identical symbols are lined up in any adjoined columns on the predetermined pay line.

The gaming machine 1 according to the present embodiment varies symbols displayed in each cell 64 of the determination region 60 based on a symbol sequence of the virtual reel set 70, and after completing varying the symbols and stopping the symbols in each cell 64, provides a feature function when a predetermined condition is satisfied. By this feature function, the symbols displayed in a part or all of the cells in the determination region 60 is replaced with an added wild symbol, and thereby the expected value of a winning number and higher price winning is improved. Accordingly, it can provide a higher excitement and entertainment to a player. Such feature function can be applied to either common games (also referred to as main games or prime games) or special games (including bonus games and free games) that is provided when a trigger condition is satisfied in a common game.

Figure 6B:
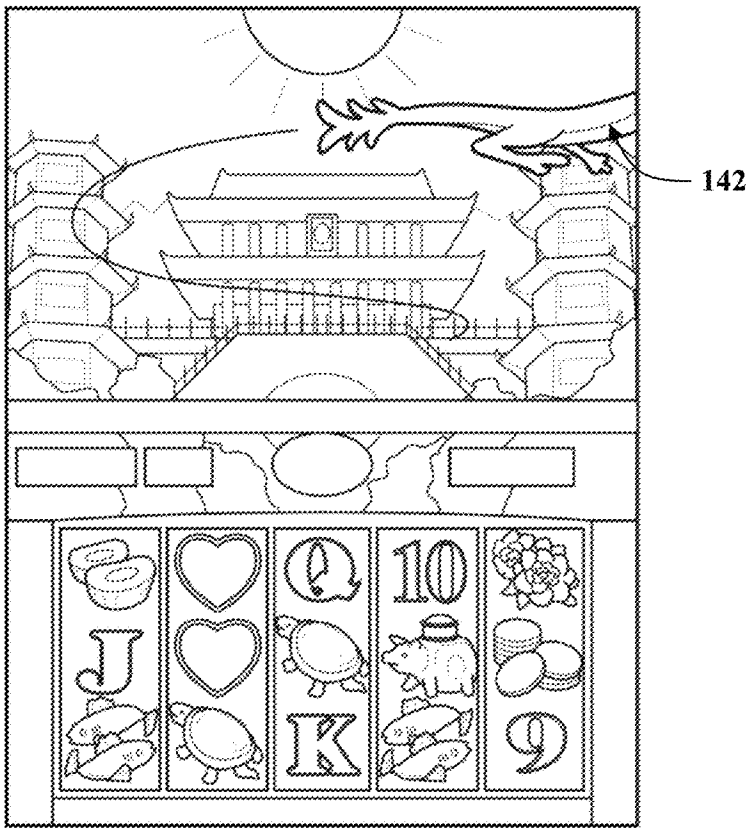
FIGS. 6A-6D are diagrams showing a screen transition of a feature function.
Figure 6A:
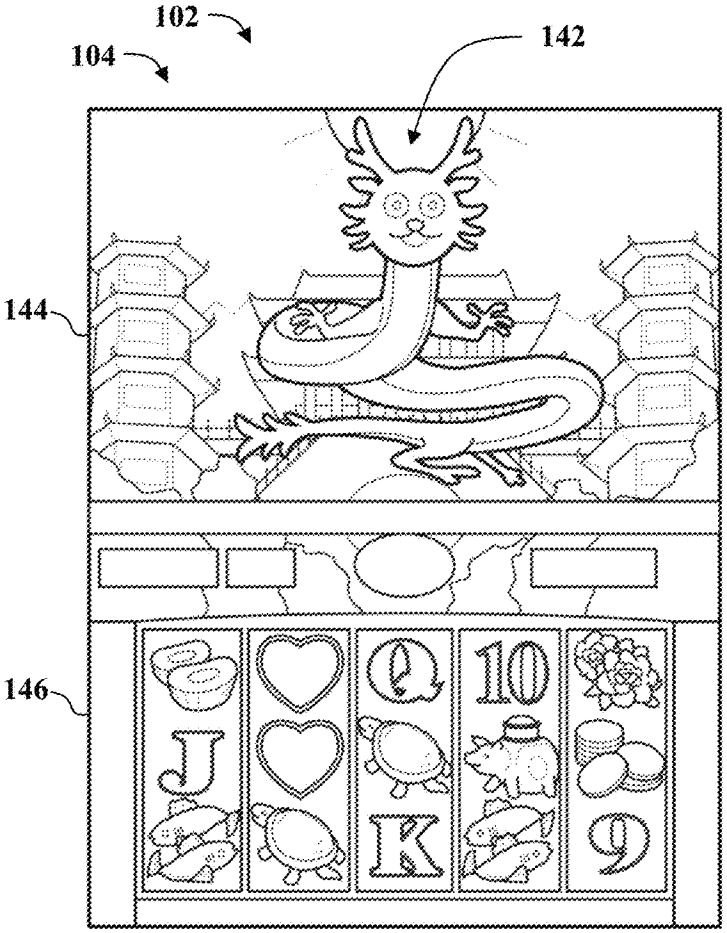
Figure 6D:
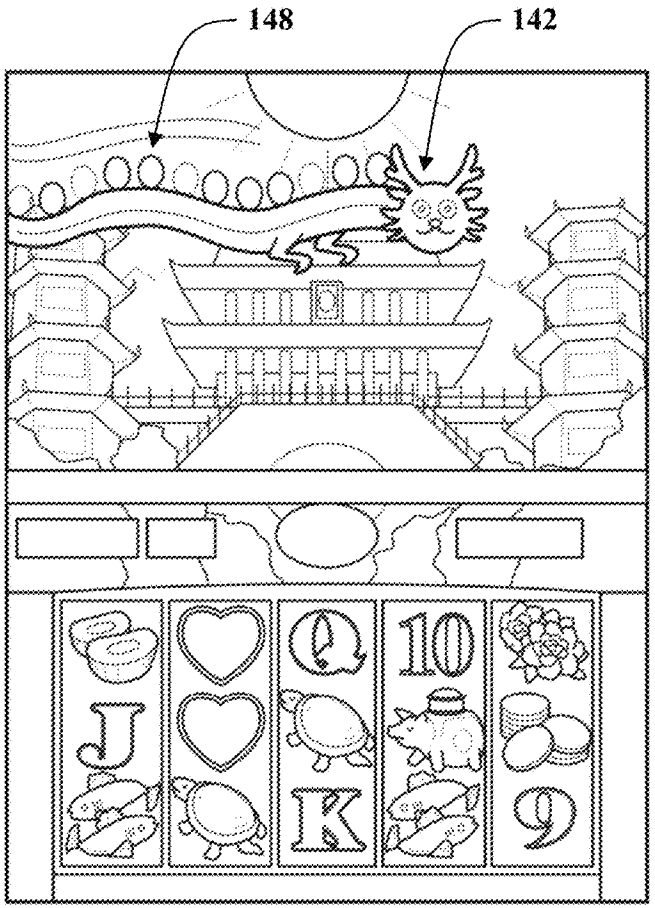
Figure 6C:
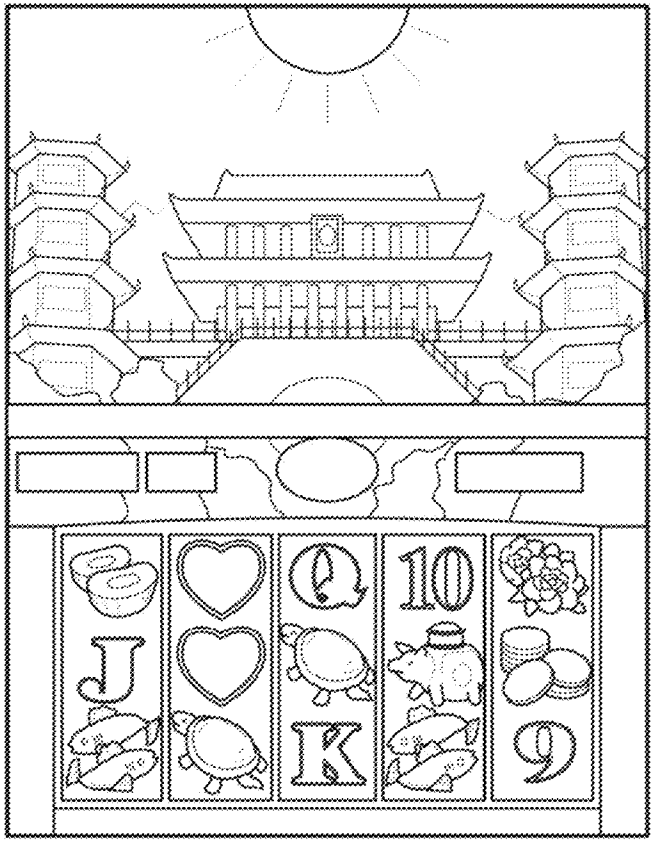

FIGS. 6A to 6D are scenes illustrating an example of screen transition when the feature function is provided by satisfying the predetermined condition in the gaming machine 1 according to the present embodiment. FIG. 6A is a scene illustrating a state when symbols are stopped in each cell 64 in the determination region 60 before the feature function is triggered. As is illustrated in the scene, the determination region 60 is displayed in the lower part display 26 in this example. Meanwhile, in a step of FIG. 6A, a dragon character that gives a staged effect when the feature function is provided is displayed in the upper part display 21. The feature function is triggered by satisfying the predetermined condition from this state, and first, the dragon character retreating to the outside of the screen from the right end of the screen as illustrated in FIG. 6B, and the screen with no dragon character is displayed as illustrated in FIG. 6C. Thereafter, the dragon character carrying wild symbols on his back returns onto the screen as illustrated in FIG. 6D, and the feature function is provided, for example, by the dragon character carrying the wild symbols moves to the determination region 60 and distributing the wild symbol to each cell 64 of the determination region 60.

The player can visually recognize that the feature function has been triggered and can visually enjoy the process of a dragon character that has temporarily disappeared from the screen returning to the screen carrying the wild symbol by the screen transition shown in FIGS. 6A to 6D.

In addition to the above visual staged effect, the gaming machine 1 of the above embodiment provides an auditory staged effect using a 3D sound by the sound controller 63 driving the 3D enabled speakers 35 controlled by the control unit 50 between the dragon character retreating (FIG. 6B) to outside the screen from the screen right end to returning to the screen (FIG. 6D).

Figure 7:
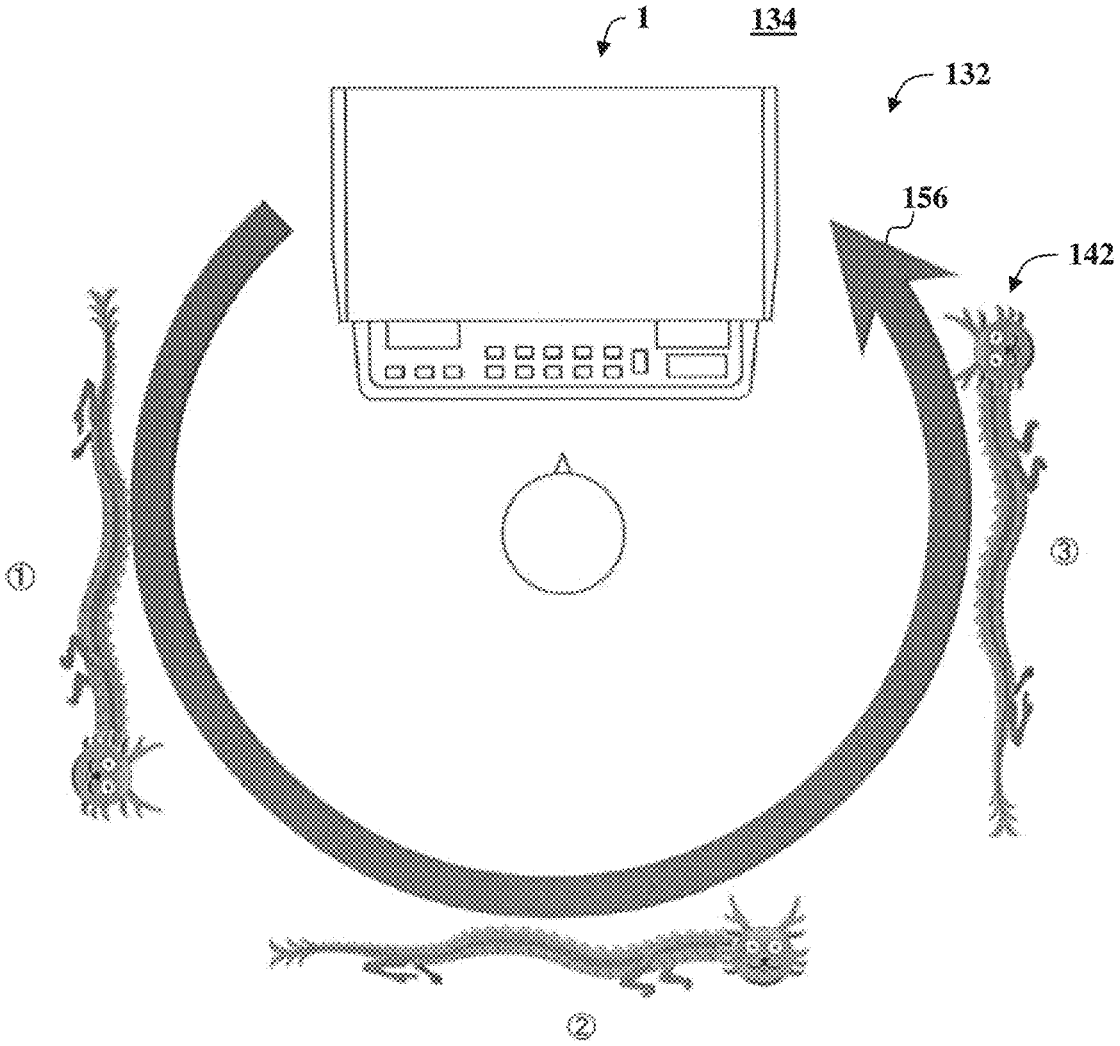
FIG. 7 is an explanatory diagram illustrating one example of staging using 3D sound.

FIG. 7 is a diagram for describing one example of an auditory staged effect using 3D sound. In this example, the auditory staged effect is designed on the assumption that the character that retreated outside the screen transitions to point ①, point ②, and point ③ along a trajectory (see the arrow in the drawing) on an arc outside the housing 10 and returning to the screen. Such staged effects can be realized in which sounds (wind noise, roaring sound, thunder, etc.) indicating the dragon moving is localized/oriented to move with the passage of time along the expected trajectory by surround mixing, and the sound data converted to the binaural system is used. That is, the staged effects can be realized by the sound controller 62 controlling the 3D enabled speaker 35 based on the sound data while the dragon character returns to the screen after retreating. It is needless to say that a timing of the visual staged effects and auditory staged effects should be matched.

By using the auditory staged effect as described above, staged effects of the game can be provided through using a space unrecognized by the player if using only the display unit 27, and a user experience that doesn't currently exist in gaming machines is possible to be given to the player.

Figure 8:
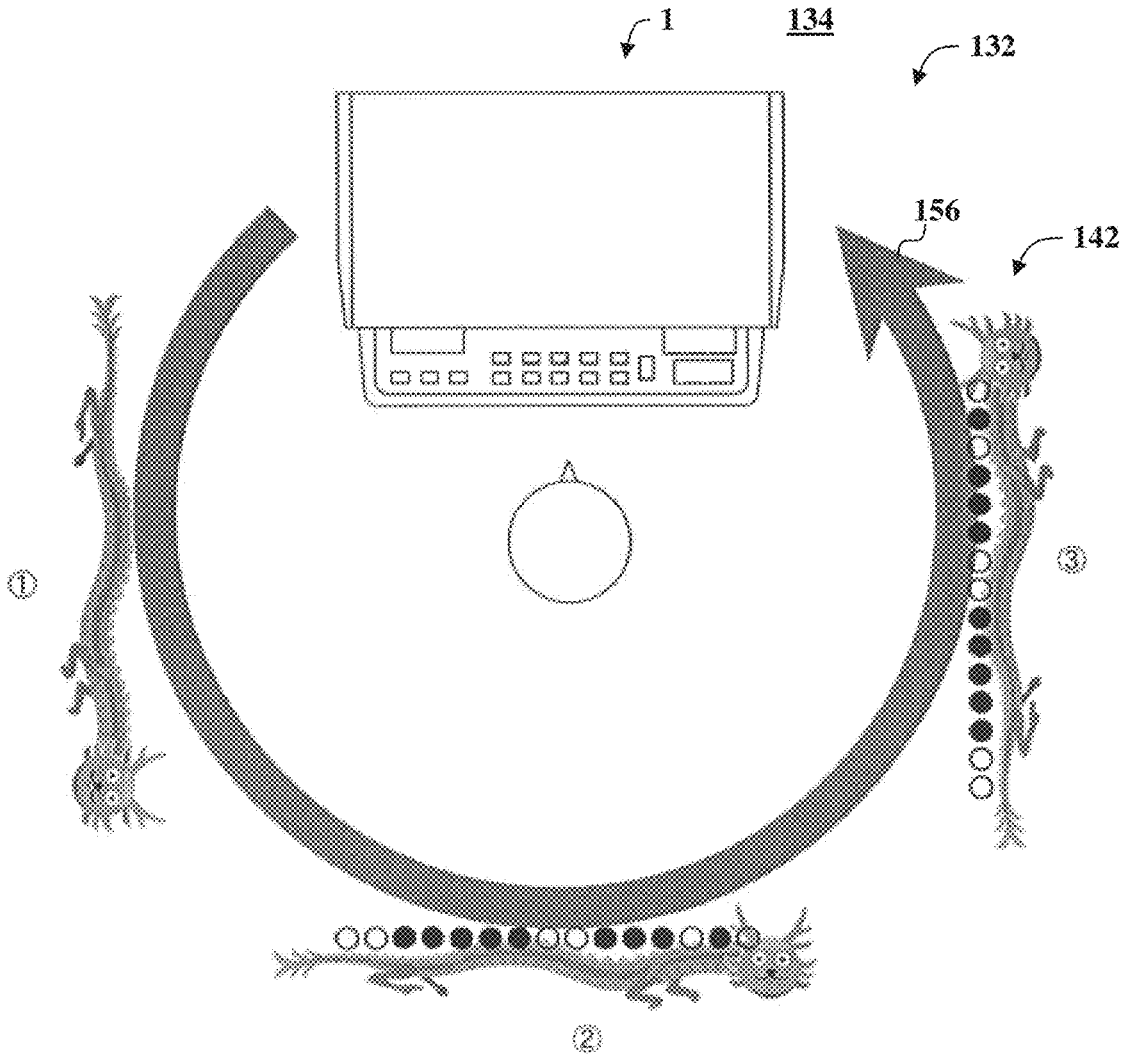
FIG. 8 is an explanatory diagram illustrating another example of staging using 3D sound.

FIG. 8 is a diagram for describing another example of an auditory staged effect. This example has no difference from the previous example in the point where the character retreated to outside of the screen travels along a trajectory on an arc. However, there is a difference from the previous example in the point having a story configuration where the character does not carry wild symbols at the point ①, carries the wild symbols at the point ②, and returns to the screen through ③. Note that, in FIG. 8, at point ②, ○ indicates a position where no wild symbol is carried and ● indicates a position where a wild symbol is carried (the same applies to the following diagrams).

Figure 9A:
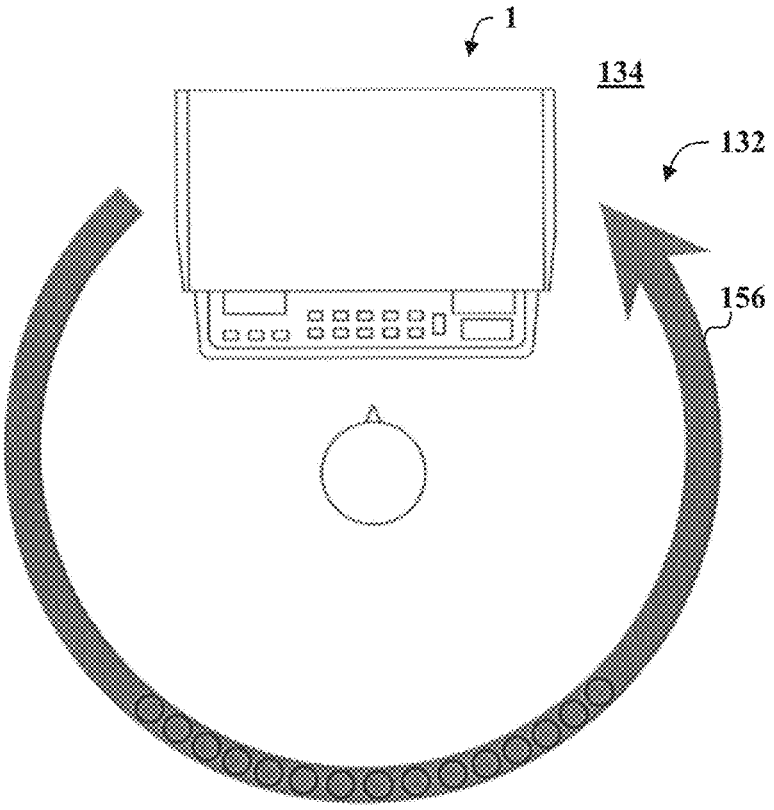
FIGS. 9A and 9B are explanatory diagrams illustrating still another example of staging using 3D sound.
Figure 9B:
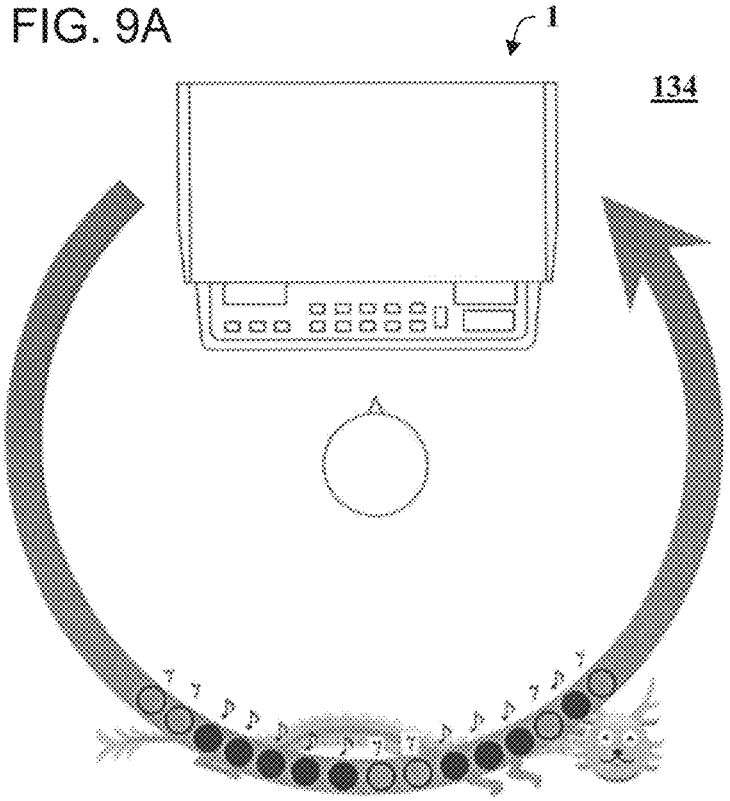
Figure 10A:
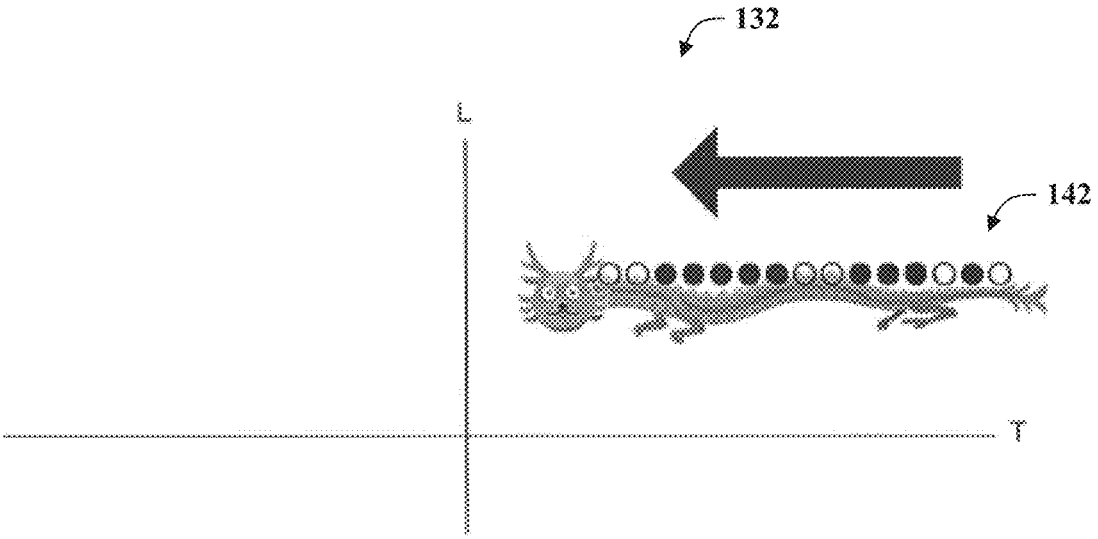
FIGS. 10A and 10B are explanatory diagrams illustrating still another example of an effect using 3D sound.
Figure 10B:
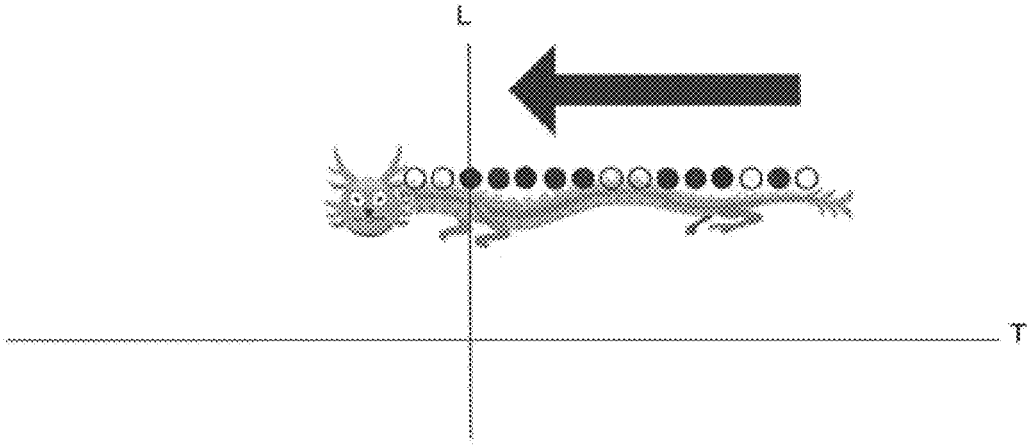

In order to acoustically express that the wild symbols are carried at the point ②, it may have a mode, for example, coordinates are estimated according to positions where the wild symbols are carried on the trajectory as illustrated in FIG. 9A, sound (sound effect) is provided for expressing a wild symbol on a position where actually the wild symbol is carried as illustrated in FIG. 9B, and the sound is not provided on a position where the wild symbol is not carried. Such mode can be realized by, for example, preparing, for a number of positions carrying the wild symbols, sound data oriented sound for expressing a wild symbol on each of the positions where the wild symbol is carried by the surround mixing, and combining to the sound data at a predetermined timing in accordance with necessity. When using a plurality of sounds expressing the wild symbols, those sounds may be played simultaneously, or may be played in order with a predetermined time difference. Further, as illustrated in FIGS. 10A and 10B, a reference position L is fixed on a trajectory T, and the sound for expressing wild symbols may be provided at a timing when a wild symbol reaches the reference position L.

By providing the sound in accordance with a wild symbol added in such manner, the player can recognize a quantity and/or a position where wild symbols are added through auditory staging. Therefore, the feature function can be provided to the player whose hopes have been raised from the auditory staging by presenting the confirmed content by giving the visual staging. By providing the player in a mode where the auditory staging and the visual staging are matched semantically, an extremely excellent user experience can be realized.

Further, when additional symbols are multiple kinds, for example, when adding a multiplier wild that gives a predetermined magnification to a winning amount in addition to the wild symbols, sound (sound effect) for expressing a symbol by the kind of additional symbol may be used selectively. The auditory staging and the visual staging can be matched and an extremely excellent user experience can be realized by using a sound according to a kind of additional symbol.

Figure 11:
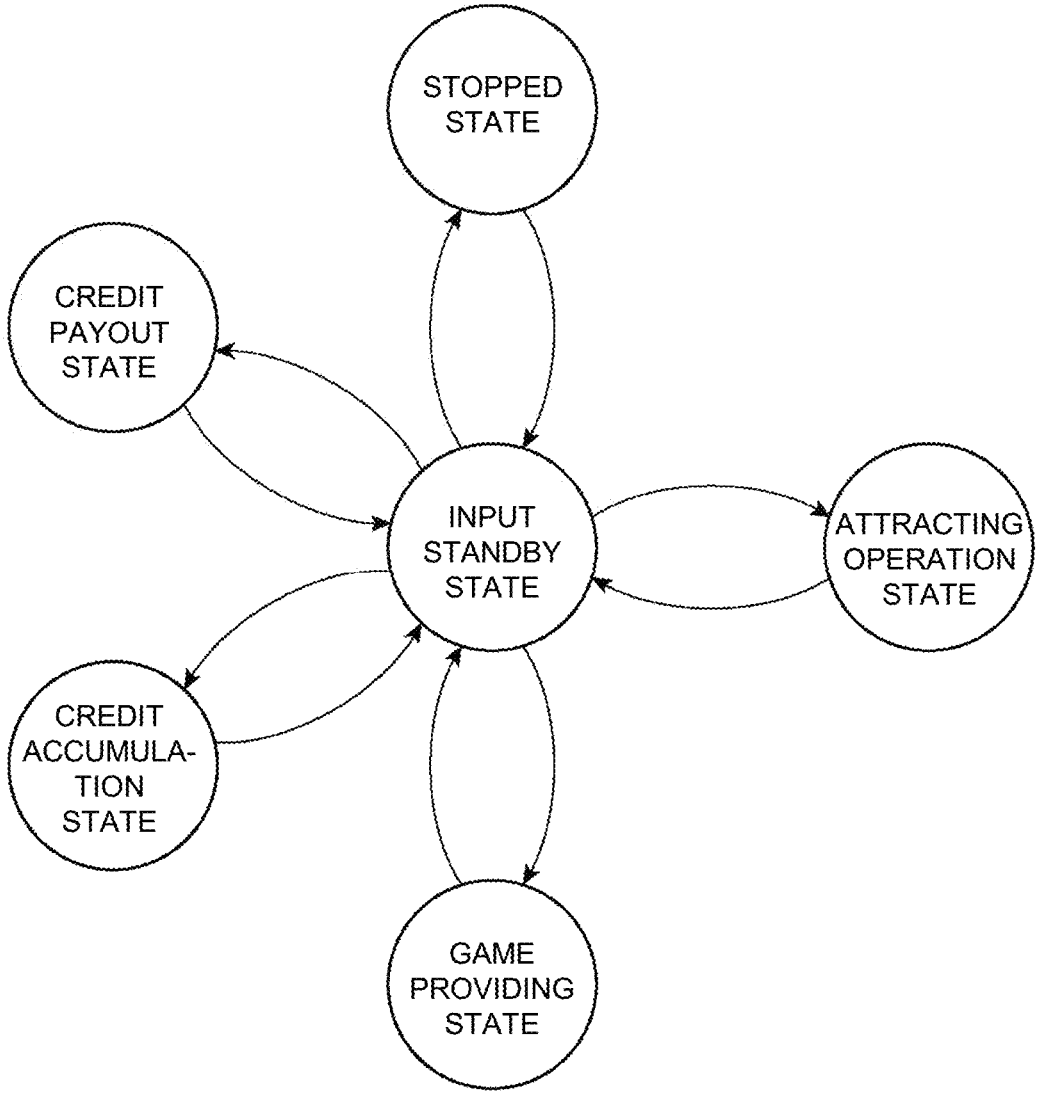
FIG. 11 is a situation transition diagram of the gaming machine.

Next, operations of the gaming machine 1 according to the present invention are described with reference to FIG. 11. FIG. 11 is a state transition diagram of the gaming machine 1 according to the present invention that is configured as described above. As illustrated in FIG. 11, the gaming machine 1 has various states of a stopped state, an input standby state, a credit payout state, a credit accumulation state, an attract operation state, and a game providing state. Each state will be described below.

A stopped state is when the gaming machine 1 is not started. The gaming machine 1 in a stopped state, upon accepting a predetermined start operation, is started or initiated, the predetermined program is executed by the control unit 50, the game screen is displayed on the display 27, and it enters an input standby state.

The gaming machine 1 in an input standby state, upon the paper money/ticket identification unit 55 identifying paper money or a ticket, transitions to a credit accumulation state to accumulate information for corresponding credit in the gaming machine 1, and when the accumulation of credit ends, it returns to an input standby state. Further, the gaming machine 1 in an input standby state, upon accepting an operation by the payout button when credit information has been accumulated, transitions to a credit payout state by processing a payout for the accumulated credit, outputs a ticket from the printer unit 56 having printed information corresponding to the credit payout process, and returns the accumulated credit to zero inside the gaming machine 1. The gaming machine 1 having completed the above process returns to an input standby state.

The gaming machine 1 in the input standby state, when having not been operated for a predetermined time, transitions to an attracting operation state that displays an attracting screen on the upper display 21 and the lower display 26. The gaming machine 1 in the attracting operation state returns to the input standby state upon accepting any operation. Note that the attracting screen is a screen for appealing the existence of the gaming machine 1 to the customers in the casino and is composed of predetermined images and/or video.

The gaming machine 1 in the input standby state, when credit has been accumulated therein, sets the number of lines and the number of bets for the game by accepting an operation by the line selection button, the number of bets selection button, or the max bet button and transitions to a game providing state when accepting an operation from the start button to reduce the credit amount by the credit amount for the set number of lines x. In the game providing state, the game is provided according to the flowcharts shown in FIG. 12 and FIG. 13. Transition to the game providing state may also occur according to an operation by the number of bets selection button or the max bet button.

Figure 12:
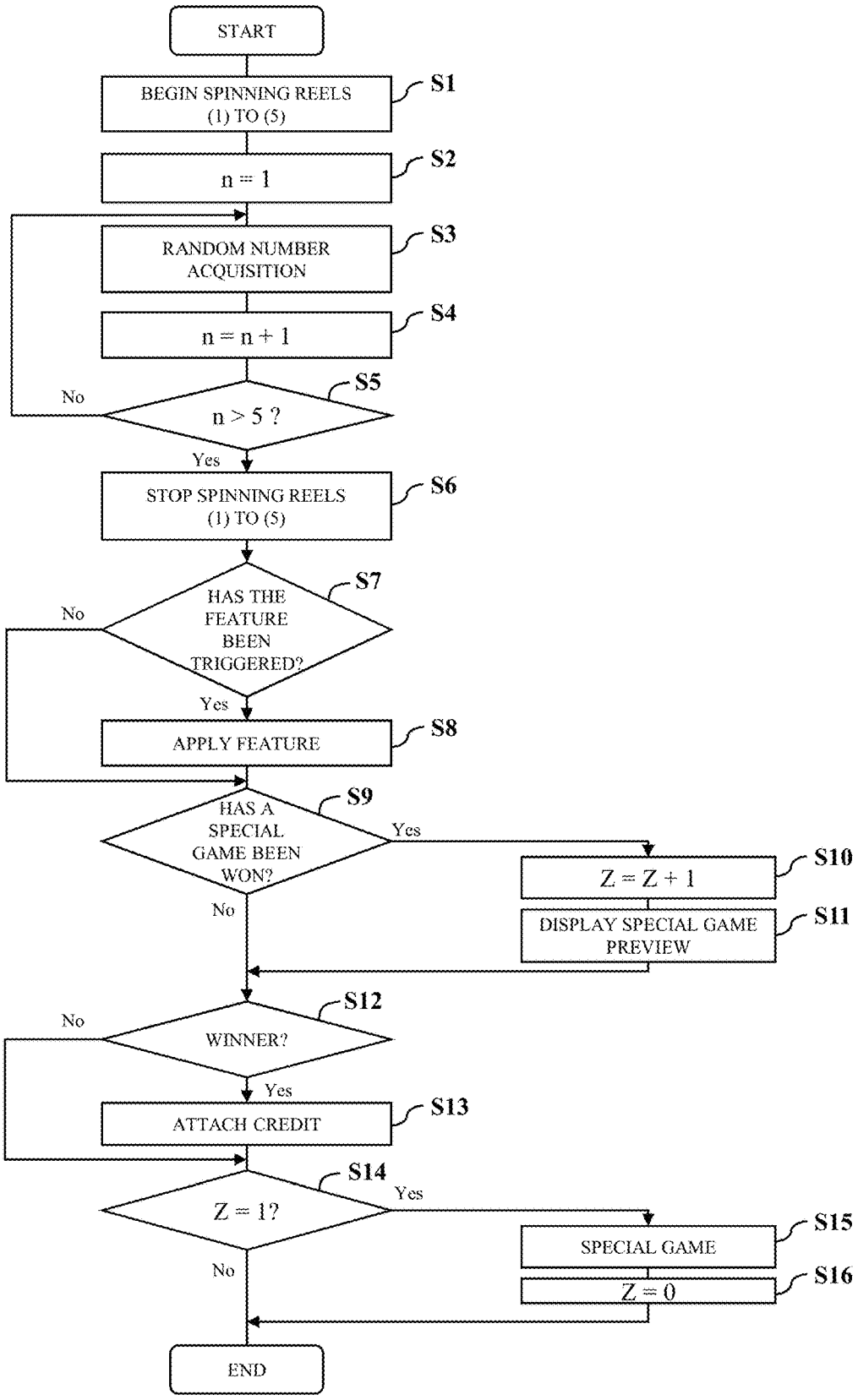
FIG. 12 is a flowchart showing actions of the gaming machine.

Operations in the game providing state will be described below with reference to the flowcharts shown in FIGS. 12 and 13 as the control method of the gaming machine 1 described above.

The gaming machine 1 in which the number of lines and the number of bets are set in the input standby state and which has transitioned to the game providing state by accepting an operation from the start button begins a normal game by controlling the upper display 21 and the lower display 26 by the control unit 50.

First, in the process of S1, the control unit 50 begins to spin reels (1) to (5) displayed in the determination region 60. More specifically, the control unit 50 scrolls columns of symbols displayed in the two-dimensional determination region 60 in a vertical direction (up-down direction) in the display unit 27 in an order determined in virtual reel strips 71 to 75 corresponding to the columns of symbols, and the rotating of the reels and symbols is displayed virtually. Next in the process of S2, the control unit 50 sets n=1 for a parameter as the initial process.

In the next process of S3, the control unit 50 acquires a random number and determines a stopping position for the reel (n) based on the acquired random number. The method for the control unit 50 to acquire a random number is not limited to a specific method and may be anything according to the regulation of the jurisdiction in which the gaming machine 1 is installed. The stop position of the reel (n) here corresponds to a stop position of the corresponding virtual reel strips 71 to 75. Accordingly, the stop position may be stipulated, for example, by associating a number or a numerical range to each symbol in the virtual strips 71 to 75 to determine the position of the symbols associated with the number or numerical range that includes the acquired random number. In this case, a gradient or bias may be established for the probability to become the stop position by unevenly stipulating the number or numerical range associated to each symbol. After the stop position of the reel (n) is determined, the process proceeds to S4.

At the process at S4, the control unit 50 sets n=n+1. After setting, the process proceeds to S5. At the process at S5, the control unit 50 determines whether n>5 is satisfied. If n>5 is not satisfied, the process proceeds to S3. By this, the process of S3 and S4 is repeatedly executed until n>5 is satisfied. By this, the stop positions for reels (1) to (5) are determined. If n>5 is satisfied in S5, this means the stop positions are determined for all of the reels (1) to (5) and the process proceeds to S6.

In the process of S6, the control unit 50 stops the reels (1) to (5) based on the stop positions of each of the virtual reel strips 71 to 75 determined in the process of S3. More specifically, the columns of symbols displayed in the scroll in the determination region 60 stop in the determined to stop positions based on the respective virtual reel strips 71 to 75.

In the process of S7 as a continuation of the process of S6, the control unit 50 determines whether a predetermined condition has been satisfied for triggering a feature function. The determination made here may be carried out, for example, based on whether the random number newly acquired by the control unit 50 corresponds to a predetermined value or predetermined range. If it is determined that the predetermined condition is not satisfied (S7; No), the process proceeds to S9. On the other hand, if it is determined that the predetermined condition is satisfied (S7; Yes), the process proceeds to provide the feature function of S8. Note that the details of the process of S8 are described below.

As the process proceeds to S9 after the process of S7, at the process of S9, the control unit 50 determines whether the symbol displayed in the determination region 60 satisfies a predetermined condition for providing a special game (free game). Examples of winning conditions for a free game include when a winning combination of predetermined symbols have been achieved in the pay line (line determination), and/or when a predetermined number or more of a particular symbol (scatter symbol) appears in the determination region 60 (scatter determination).

When it is determined that the predetermined condition for providing a free game is satisfied in the process of S9, a free game providing flag Z is set to Z=Z+1 in the process of S10. After the flag is set in the process of S10, the process of S11 provides a notice to be displayed in the upper display 21 or the lower display 26 that a free game will be provided.

When it is determined that the predetermined condition for providing a free game is satisfied in the process of S9 and after the process of S11, or when it is not determined to be satisfied, after the process of S9, the control unit 50 determines in the process of S12 whether the symbol displayed in the determination region 60 wins a prize. For example, it is determined whether the line determination and/or scatter determination is applied to a different condition than the predetermined condition for providing a free game and whether it wins a prize. If it is determined that it wins a prize, a predetermined credit is calculated in the process of S13 according to the order described below, and the calculated credit is added to the credit accumulated in the gaming machine 1.

When it is determined that a prize is won in the process of S12 and after the process of S13, or when it is not determined to have won a prize, after the process of S12, it is determined subsequently in the process of S14 whether the flag is set to Z=1, and if it is set to Z=1, the process proceeds to S15 where the control unit 50 provides a predetermined number of free games that does not consume a game value. If the predetermined condition during a free game is satisfied the process proceeds to add a correction such as the addition of the number of free games when a different predetermined condition is satisfied.

When the predetermined number of free games has ended, the flag is set to Z=0 in the process of S16 subsequent to the process of S15, and the gaming machine 1 terminates the game providing state and returns to the input standby state. Further, if it is determined that the flag has not been set to Z=1 in the process of S14, the gaming machine 1 terminates the game providing state and returns to the input standby state. Accordingly, the actions in the game providing state terminate.

Figure 13:
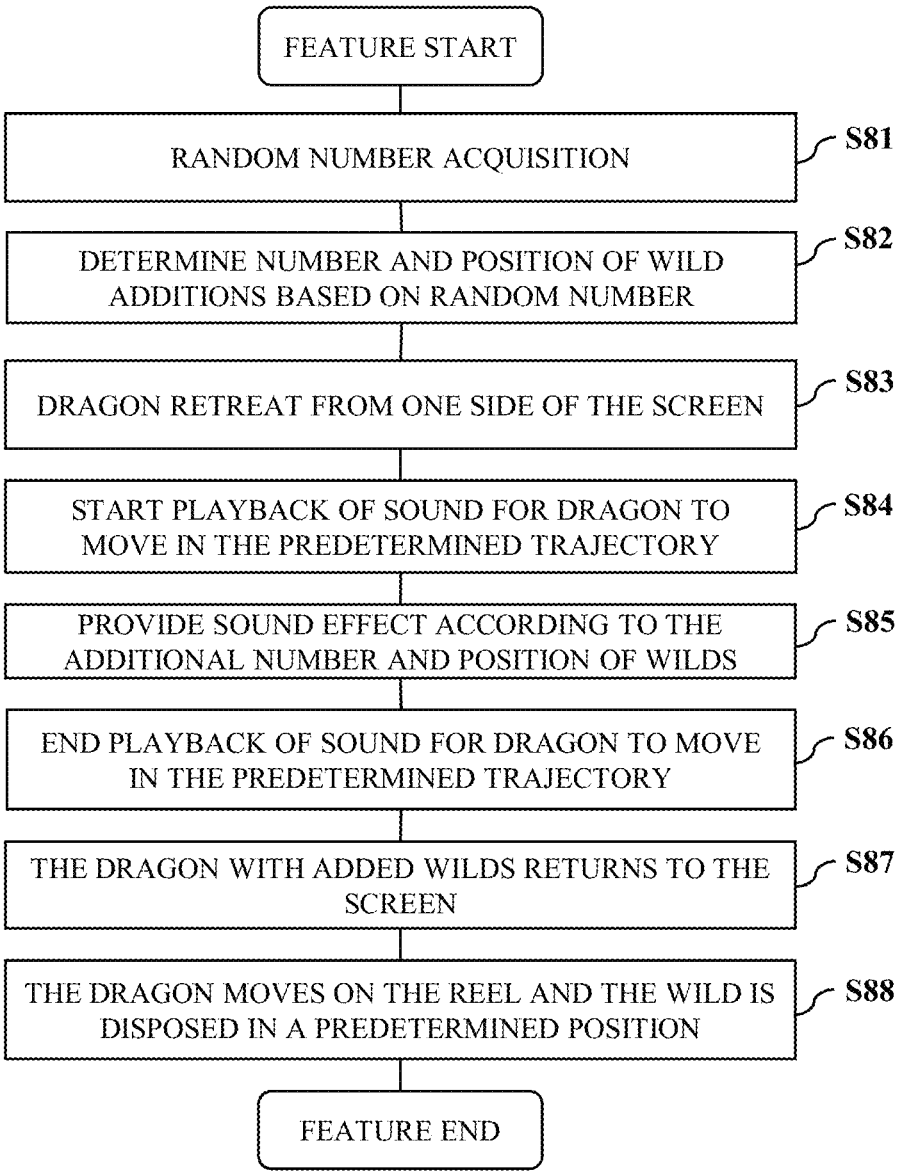
FIG. 13 is a flowchart of actions provided in a feature effect.

Here, a detailed description will be provided of the process in S8 with reference to FIG. 13 of when the process proceeds to provide the feature staged effect of S8 after the process of S7.

When beginning to provide the feature staged effect, the control unit 50, first, acquires a random number in the process of S81, and in the process of S82, it determines the number and position of wild symbols to be added based on the acquired random number. Here, the position for adding the wild symbol means the position of the cell 64 replaced by the additional wild symbol. When each of the cells 64 corresponds to a predetermined position on the dragon, determining the position for adding the wild symbol is the same for when determining the position for placing the wild symbol on the dragon.

Next, the control unit 50 controls the display unit 27 in S83 to display a screen where the dragon is retreating from one side of the display unit 27 as shown in FIG. 6B and drives the 3D enabled speakers 35 by controlling the sound controller 62 in S84 to begin to play a sound where the dragon moves along a predetermined trajectory. Further, in S85, a sound effect corresponding to the number and position of added wild symbols are provided at a predetermined timing by the sound controller 62 and the 3D enabled speakers 35 in a similar manner.

Afterwards, the control unit 50, in S86, terminates the playback of the sound where the dragon moves on a predetermined trajectory and in S87 controls the display unit 27 to display a screen where the dragon carrying a wild symbol on a predetermined position on his back as shown in FIG. 6D returns, then in S88 moves the dragon onto the determination region 60, disposes each wild symbol in a determined cell 64 and carries out a process for replacing the symbol displayed in the cell 64 with the wild symbol. The process for providing the above feature function terminates, and the process subsequent to S9 is executed in a similar manner when the feature function is no longer provided thereafter.

One embodiment of the present invention is described above; however, the present invention is not limited to the aforementioned embodiment, and a variety of modifications are possible.

Figure 14:
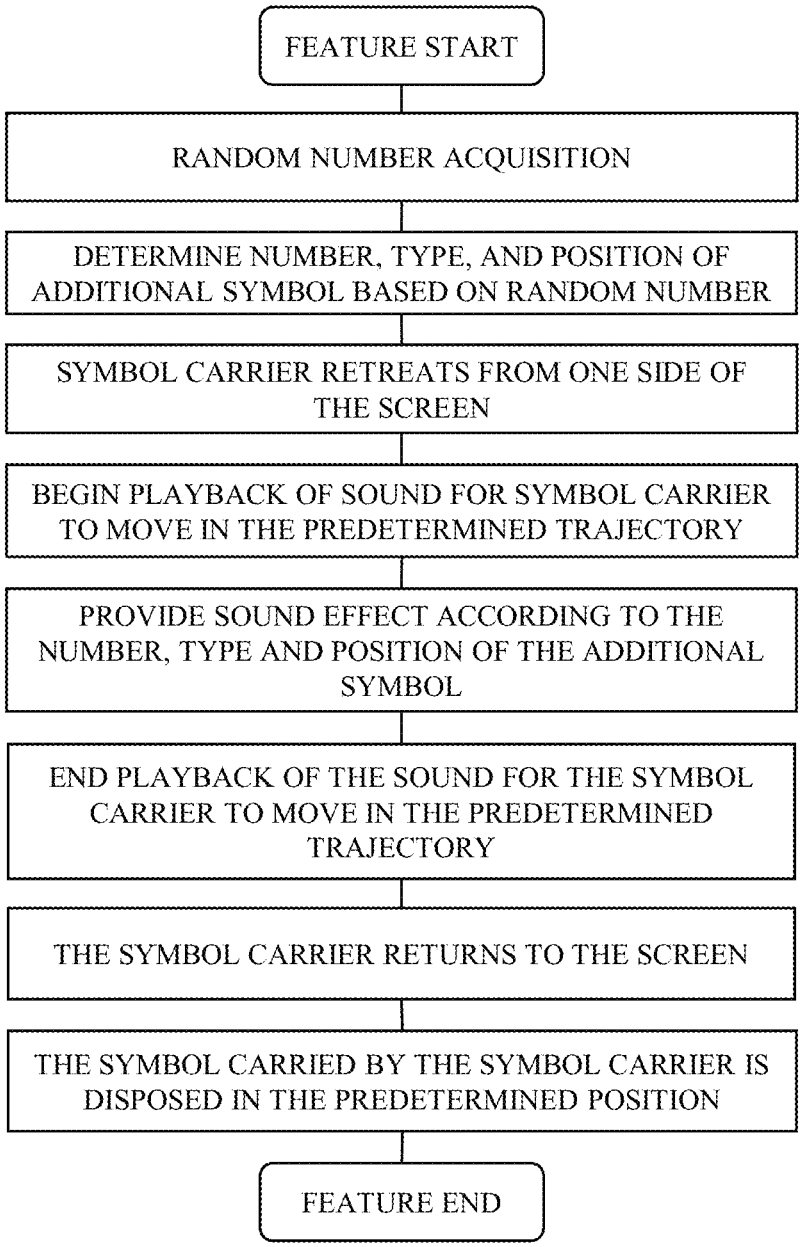
FIG. 14 is another flowchart of actions provided in a feature effect.

For example, in the above embodiment, a description is given of a dragon character carrying the additional symbol, but it is not limited to this. The type of character is not limited, and wind or water may be acceptable modes for carrying the symbol. FIG. 14 shows a flowchart of when the dragon of FIG. 13 is the symbol carrier. Further, in the above embodiment, a dragon as one example of a symbol carrier is expressed in a mode for traveling externally of the display unit 27 depicting an arc shaped trajectory, but the expression used for 3D sound is not limited to this. For example, a mode expressed by an auditory staged effect that looms from behind the player with a subsequent visual staged effect next displayed on the screen is also possible. A plurality of expression patterns that utilize 3D sound may be prepared and any expression pattern may be selected and executed randomly or according to progress or a result in the game.

Further, in the above embodiment, and upright type gaming machine 1 is displayed having the display unit 27 installed therein, but the present invention can also apply to a slanted gaming machine 1 in which the display unit 27 is provided at a slant. Furthermore, a configuration in which the speaker cabinet 36 housing 3D enabled speakers 35 is disposed on top of the first cabinet 20 is given in this embodiment, but the speaker cabinet 36 may be disposed between the first cabinet 20 and the second cabinet 25, or it may be disposed to be between the second cabinet 25 and the third cabinet 30 and between the third cabinet 30 and the fourth cabinet 40. Additionally, the configuration may provide the 3D enabled speakers 35 to be housed in any cabinet.

In the above embodiment, a gaming machine that provides a game in a slot machine mode is described, but it is not limited to this. Any game may be provided in a mode such as a video card game as a poker or blackjack, bingo, keno, a wheel game, and the like. Moreover, the present invention can also be applied to a pachinko machine or a pachislot machine.

In the above embodiment, a description is given for determining a position to stop each reel, determining whether trigger conditions exist to provide a feature function, determining an appearance pattern for additional wild symbols, and for sequentially acquiring random numbers used in each determination of the position for stopping the special reel, but the random number acquisition order is not limited to this. For example, the control unit 50, at the start of the game, may acquire these random numbers in a batch and store each of the random numbers in a storage region of the memory 53 or the storage 54 that is not erased in the event of a power outage. When configured in this manner, even if a power outage or the like occurs during gameplay, the control unit 50, when restarting the game after the power has been restored, can reproduce the progress of the game by acquiring the random numbers acquired at the start of the game prior to the power outage from the memory 53 or the storage 54. For example, if the power outage occurred immediately prior to forming a game result in which a high payout were to be obtained, and the same game progression were not restored after the power has been restored, the player would feel significant dissatisfaction. However, acquiring all random numbers in a batch when starting a game as described above and saving these random numbers in the memory 53 or the storage 54 allows the same game progression to be restored as that prior to the power outage after the power is restored thereby avoiding the above-described significant dissatisfaction in the player.

Further, in the above embodiment, modes for displaying paper money or a ticket as a gameplay value, accepting these by a paper money/ticket identification device, and outputting a ticket by a printer unit is described, but the present invention is not limited to this. The gameplay value is a concept that includes a tangible object such as hard currency, paper money, coins, medals, tickets, and the like, or electronic data having a value equivalent to these. For example, a mode for payment of coins from a coin hopper by receiving coins into a coin acceptor is also acceptable. A mode that uses the accumulated credit in an account on a server that identifies a player and pays out credit to the account is acceptable, as well as a mode that reads and accepts information of credit stored in a recording medium such as a magnetic card, and IC card, and the like, and pays out credit by writing to the storage medium.

Further, in the above embodiment, a case for providing a free game has a special game is described, but a bonus game may be provided that uses a different virtual reel strip from the normal game. Moreover, a feature game provided according to a value a random number acquired during a normal game may also be provided.

Further, a configuration may be provided such that a predetermined condition for providing a bonus game is not limited to a scatter determination or a line determination, but a bonus game may be provided, for example, when a number of bets exceeds a predetermined value. A configuration is also possible in which a bonus game is provided according to a value of a random number provided during normal gameplay.

Further, in the above embodiment, a mode for providing a predetermined number of free games is described as a bonus game, but bonus games may be provided without limiting the number. In this case, a configuration may be to set a termination condition of the bonus game to be a combination of special symbols or determination based on a random number bonus game is provided until the termination condition is met.

Referring to FIG. 1, in one embodiment, the gaming machine 1 includes a sound reproduction system that includes the 3D enabled speakers 35. The sound reproduction system is configured to generate a sound feature within a listening space that surrounds the gaming machine 1. The sound feature includes 3D game sounds that include one or more 3D sound effects traveling along one or more sound paths that are orientated with respect to a player positioned within the listening space. The sound reproduction system emits the sound feature to facilitate simulating, to the player, a game element moving within the listening space. Additional details of sound reproduction systems, which may be used in the present invention, are described in U.S. Pat. No. 6,950,524 to Phillip Nelson et al., issued Sep. 27, 2005, titled "Optimal Source Distribution", which is incorporated herein by reference in its entirety.

In one embodiment, the gaming machine 1 may include a slot machine installed in a casino. In another embodiment, the gaming machine 1 may include a personal computer, laptop, cell phone, smartphone, tablet computer, personal data assistant, and/or any suitable computing device. Referring to FIG. 1, in one embodiment, the control panel 41 may include a plurality of user input devices that may include an acceptor device which accepts media associated with a monetary value to establish a credit balance, a validator configured to identify physical media, and a cash-out button actuatable to cause an initiation of a payout associated with the credit balance. The acceptor device may include a touchscreen display associated with the display unit 27 and/or the player tracking unit 57, the paper money/ticket identification unit 42, the operation unit 44, the player tracking unit 57, a coin slot, a ticket-in ticket-out (TITO) system, a bill acceptor, and/or any suitable device that enables the gaming machine 1 to receive media associated with a monetary value and establish a credit balance for use in playing the gaming machine 1.

In one embodiment, the acceptor device may be configured to receive physical media such as, for example, a coin, a medal, a ticket, a card, a bill, currency, and/or any suitable physical media that enables the gaming machine 1 to function as described herein. The acceptor device may also be configured to accept virtual media such as, for example, an RFID signal, a keypad and/or touch screen entry, a personal identification number and/or identifier, a player tracking account, a virtual credit balance, reward points, gaming credits, bonus points, and/or any suitable virtual media that enables the gaming machine 1 to function as described herein. For example, in one embodiment, the coin slot may include an opening that is configured to receive coins and/or tokens deposited by the player into the gaming machine 1. The control unit 50 converts a value of the coins and/or tokens to a corresponding amount of gaming credits that are used by the player to wager on games played on the gaming machine 1. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 1. In one embodiment, the bill acceptor also includes a printer that is configured to dispense a printed voucher ticket that includes information indicative of an amount of credits and/or money paid out to the player by the gaming machine 1 during a gaming session. The voucher ticket may be used at other gaming devices, or redeemed for cash, and/or other items as part of a casino cashless system.

In one embodiment, the control panel 41 may include a plurality of BET switches for inputting a wager on a game, a plurality of selection switches for selecting a betting line, a payline, and/or card, a MAXBET switch for inputting a maximum wager, a PAYOUT switch for ending a gaming session and dispensing accumulated gaming credits to the player, and a start switch, i.e., a SPIN/DEAL button to initiate an output of a game.

For example, in one embodiment, the BET switches may include five switches from 1BET to 5BET to enable a player to wager between a minimum bet up to 5× minimum bet. Each selection switch corresponds to a betting line such as, for example, a payline and/or symbol for a reel game, one or more cards for a card game, and/or a symbol for a roulette game, to enable a player to associate a wager with one or more betting lines. The MAXBET switch enables a player to input the maximum bet that a player can spend against one play of a game. The PAYOUT switch enables a player to receive the amount of money and/or credits awarded to the player during a gaming session, which has been credited onto the gaming machine 1.

The gaming machine 1 may also include the player tracking unit 57 that is coupled to the control unit 50 for identifying the player and/or a player tracking account that is associated with the player. The player tracking account may include, but is not limited to, gaming credits available to the player for use in playing the gaming machine 1. The player tracking unit 57 is configured to communicate player account information between a player tracking controller and the gaming machine 1. For example, the player tracking unit 57 may be used to track bonus points and/or credits awarded to the player during a gaming session and/or track bonus and/or credits downloaded to the gaming machine 1 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking unit 57 may be coupled to the gaming machine housing 10 and may include a player identification card reader, a data display, and a keypad. The player identification card reader is configured to accept a player tracking card inserted by the player, and read information contained on the player tracking card to identify the player account information. The player identification card reader may include, but is not limited to, a barcode reader, a magnetic card reader, and/or a radio frequency identification (RFID) card reader. The keypad is configured to accept a user selection input such as, for example, a unique player personal identification number (PIN) to facilitate enabling the gaming machine 1 to identify the player, and access player account information associated with the identified player to be displayed on the data display. In one embodiment, the data display includes a touchscreen panel that includes the keypad. Alternatively, the data display and the keypad may be included in the display device.

In the illustrated embodiment, the display device 27 is configured to display a game 102 on a game screen 104 (shown in FIGS. 6A-6D and 17-20) including indicia and/or symbols for use in the game 102, e.g., cards used by a card game, roulette wheel and symbols used in a roulette game, reels used in a reel game and/or any suitable symbols and images for use in displaying a game. The game 102 may include any type of game including, but not limited to, a role-playing game, a puzzle game, a maze-type game, a video slot game, a keno game, a blackjack game, a video poker game, or any type of game which allows a player to make a wager, play a game, and potentially provide the player an award based on an outcome of the game and a paytable. In one embodiment, the display device 27 may include a first display 26 and a second display 21. Moreover, each display 26 and 21 may be configured to display at least a portion of the game screen 104 and/or game play instructions. In one embodiment, the first display 26, and/or the second display 21 may include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 27 and as the input devices. In an alternative embodiment, the first display 26 and/or the second display 21 may include a plurality of mechanical reels displaying a plurality of game symbols.

Figure 15:
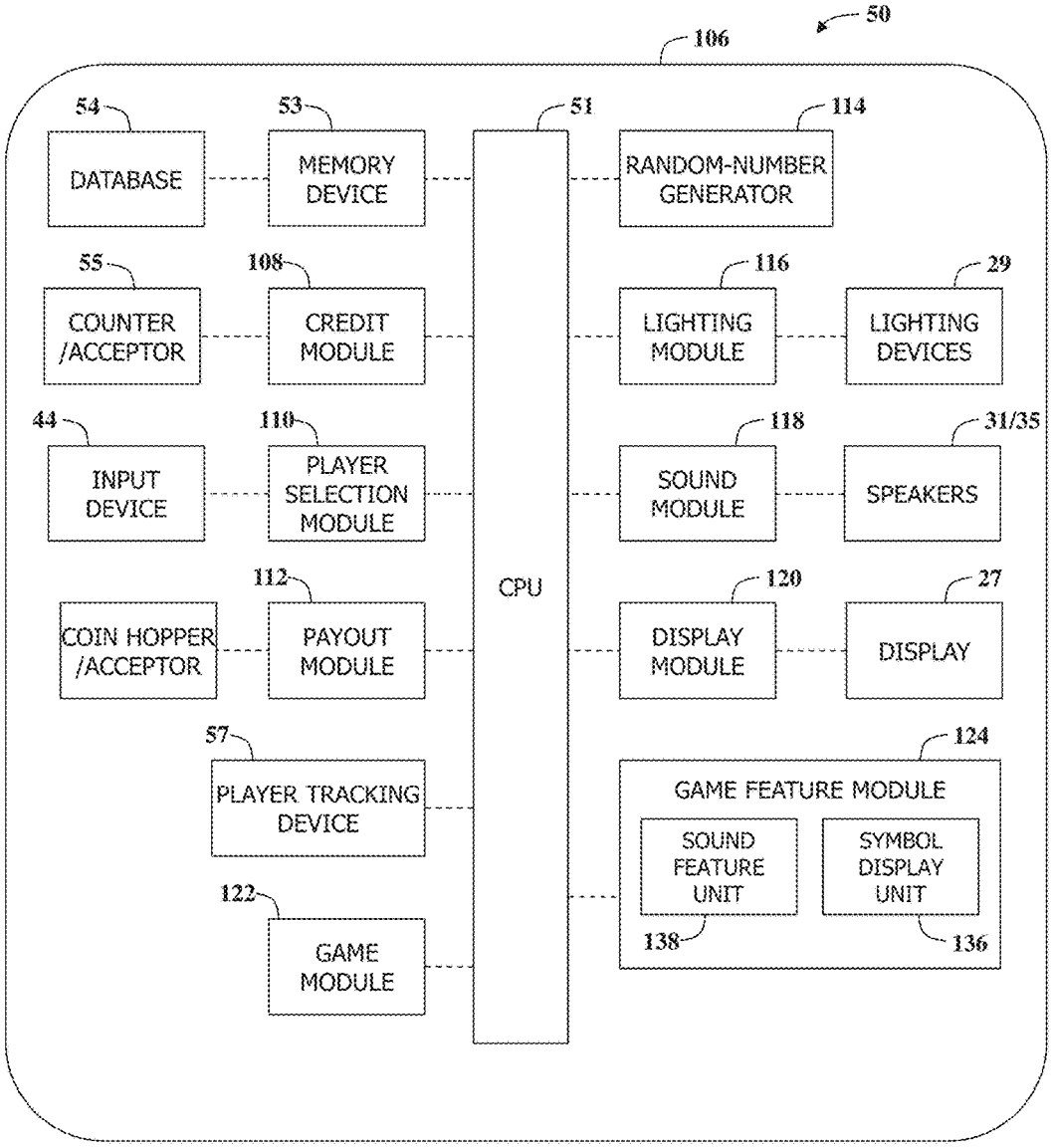
FIG. 15 is a schematic representation of a gaming controller that may be used with the gaming machine shown in FIG. 1, according to an embodiment of the present invention.

FIG. 15 is a schematic representation of the control unit 50 including a gaming controller 106 that may be used with the gaming machine 1. In one embodiment, the gaming controller 106 is positioned within the gaming machine housing 10. Alternatively, the gaming controller 106 may be separated from the gaming machine housing 10, and connected to components of the gaming machine 1 through a network such as, for example, a LAN, a WAN, dial-in-connections, cable modems, wireless modems, and/or special high-speed ISDN lines. For example, in one embodiment, the gaming controller 106 may be located remotely with respect to the gaming machine 1, or within another gaming machine located on a casino floor.

Referring to FIG. 15, in one embodiment, the gaming controller 106 may include the CPU 51, a credit module 108, a player selection module 110, a payout module 112, a random-number generator (RNG) 114, a lighting module 116, a sound module 118, a display module 120, a game module 122, a game feature module 124, the memory device 53, and the database 54. The memory device 53 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 51 to store, retrieve, and/or execute instructions and/or data.

The CPU 51 executes various programs, and thereby controls other components of the gaming controller 106 according to player instructions and data accepted by the user input device. The CPU 51 in particular executes a game program, and thereby conducts a game in accordance with the embodiments described herein. The memory device 53 stores programs and databases used by the CPU 51. Moreover, the memory device 53 stores and retrieves information in the database 54 including, but not limited to, wagers, wager amounts, average wagers per game, a game type, awards, type of awards, triggering conditions, sound effects, game symbol display effects, 3D sound features, image data for producing game images and/or screens on the display device 27, and temporarily stores variables, parameters, and the like that are used by the CPU 51. In addition, the memory device 53 stores indicia, symbol weights, symbol values, paytables, and/or winning combination tables which represent relationships between combinations of random numbers and types of awards. In one embodiment, the memory device 53 utilizes RAM to temporarily store programs and data necessary for the progress of the game, and EPROM to store, in advance, programs and data for controlling basic operation of the gaming machine 1, such as the booting operation thereof.

The credit module 108 may be programmed to perform some or all of the functions of the paper money/ticket identification unit 55 and manages the amount of player's credits, which is equivalent to the amount of coins and bills counted and validated by the bill acceptor. The player selection module 110 may be programmed to perform some or all of the functions of the input controller 61 and monitors player selections received through the user input device, and accepts various instructions and data that a player enters through the user input device. The payout module 112 converts a player's credits to coins, bills, or other monetary data by using a coin hopper and/or for use in dispensing a credit voucher via the bill acceptor.

The lighting module 116 may be programmed to perform some or all of the functions of the illumination controller 59 and controls one or more lighting devices to blink and/or change brightness and color in specific patterns in order to produce lighting effects associated with game play. The sound module 118 may be programmed to perform some or all of the functions of the sound controller 62 and controls the stereo speakers 31 and the 3D speakers 35 to output voice announcements and sound effects during game play.

The display module 120 may be programmed to perform some or all of the functions of the graphics controller 58 and controls the display device 27 to display various images on a graphical interface including the game screen 104 preferably by using computer graphics and image data stored in the memory device 53. More specifically, the display module 120 controls video reels being displayed with the game 102 and game symbols and images being displayed in the game screen 104 being displayed on the first display 26 and/or the second display 21 by using computer graphics and the image data. In another embodiment, the display device 27 includes a plurality of mechanical reels. The display module 120 may be configured to control a rotation of each of the plurality of mechanical reels to spin and stop each reel to display a game outcome.

The RNG 114 generates and outputs random numbers to the CPU 51 preferably at the start of each round of a game. The CPU 51 uses the random numbers to determine an outcome of the games. For example, if the game is a video slot game, the CPU 51 uses the RNG 114 to randomly select an arrangement of symbols to be displayed on video reels. Moreover, the CPU 51 generally uses random numbers generated by the RNG 114 to play the games and to determine whether or not to provide an award and/or bonus features to a player. In one embodiment, the CPU 51 may also use the random numbers to determine a stop position of each reel for use in stopping each of a plurality of mechanical reels and/or video reels being displayed in the display device 27 to display the game outcome. The CPU 51 may also receive combinations of random numbers from the RNG 114 and compare the generated combinations with winning combinations stored in the winning combination table to determine if the generated outcome is a winning outcome that is associated with a type of award. In general, the term "award" may be a payout, in terms of credits or money. Thus, the CPU 51 may award a regular payout in response to the outcome of the game 102. However, it should be noted that the term award may also refer to other types of awards, including, prizes, e.g., meals, show tickets, etc. . . . , as well as in-game award, such as bonus features, free games, and/or free spins, or awarding the player one or more wild symbols or stacked wild symbols in each of the games. In one embodiment, the RNG 114 is configured by executing a random number generating program on the CPU 51.

The game module 122 includes a game program for use in executing the game 102 being displayed on the display device 27. In the illustrated embodiment, the game 102 is a video slot game. However, it should be noted that the game 102 may be any type of game upon which a player could make a wager including, but not limited to a keno game, a blackjack game, a video poker game, or any type of game that enables the gaming controller 106 to function as described herein. During play of the game 102, the game module 122 retrieves image data and sound data from the database 54 and displays the game 102 on the game screen 104. In the illustrated embodiment, the game module 122 displays the game 102 including a plurality of reels 126 (shown in FIGS. 4A and 17). Each of the reels 126 includes a plurality of symbol positions 128 that are each displayed with a game symbol 130. The game module 122 receives one or more wagers from the player via the user input device, responsively generates and outcome of the game 102, determines if the game outcome is a winning outcome, and provides an award to the player, if any, as a function of game outcome and the wager. Moreover, the game module 122 receives one or more random numbers from the RNG 114, determines an outcome of the game 102 as a function of the received random numbers, and spins and stops the reels 126 to display the outcome of the game 102 on the display device 27.

The game feature module 124 includes a game program for use in executing a game feature event 132 (shown in FIGS. 6-10 and 17-26) during the game 102. In the illustrated embodiment, the game feature module 124 is configured to generate the game feature event 132 including a sound feature that includes a 3D sound effect being generated within a listening space 134 of the gaming machine 1. In the illustrated embodiment, the listening space 134 is defined as an area surrounding the gaming machine 1 in which the player perceives that the sounds associated with game play are being originating within. For example, in one embodiment, the sound feature may include a 3D sound effect that appears to the player to be originating from behind the gaming machine 1 and/or from behind the position of the player. In addition, the game feature module 124 is configured to generate the game feature event 132 including a game symbol display effect that includes one or more game symbols being displayed on the display device 27 in coordination with the 3D sound effect.

In the illustrated embodiment, the game feature module 124 includes a symbol display unit 136 and a sound feature unit 138. During the game feature event 132, the symbol display unit 136 generates a game symbol display effect 140 (shown in FIGS. 6A-6D and 17-20) and displays the game symbol display effect 140 on the display device 27. For example, in one embodiment as shown in FIGS. 6A-6D, the game symbol display effect 140 may include the appearance of a bonus reel 142, illustrated as a "dragon reel" shown FIGS. 6A-6D, that is being displayed within a display area of the game screen 104. During the game feature event 132, the bonus reel 142 is displayed within a first game region 144 and is moved to a second game region 146. The bonus reel 142 may include one or more special symbol regions 148 being displayed with the bonus reel 142. Each special symbol region 148 is configured to display a corresponding game symbol 130 therein. In one embodiment, the bonus reel 142 may include 15 special symbol regions 148 corresponding to the number of the cells 64 included in the game 102.

For example, in one embodiment, as shown in FIGS. 6A-6D, during the game feature event 132, the dragon reel 142 initially appears in the first game region 144, moves horizontally across the first game region 144 and disappears from the game screen 104. After a predetermined time period passes, the dragon reel 142 reappears in game screen 104 moving across the first game region 144 and appearing with a plurality of game symbols 130 being displayed on the back of the dragon reel 142. The dragon reel 142 then moves from the first game region 144 to the second game region 146 displaying an initial outcome of the game 102. The dragon reel 142 appears in the second game region 146 and moves across each of the cells 64. In one embodiment, the dragon reel 142 appears from the left edge of the second game region 146 and moves in an arrangement direction of cell columns along each of the cells 64 arranged in the top position of the cell columns. The dragon reel 142 then moves along each of the cells 64 so that all the special symbol regions 148 arranged on the back of the dragon reel 142 are overlaid over each of the cells 64. As a result of such movement, the dragon reel 142 extends across each cell 64 such that each special symbol region 148 is positioned adjacent a corresponding cell 64, and the symbols being displayed in the special symbol regions 148 overlay the symbols being displayed in the corresponding cells 64. The gaming controller 106 then evaluates the outcome of the game including the symbols displayed in the special symbol regions 148 and provides an award to the player based on the outcome. Additional details of bonus reels, which may be used in the present invention, are described in U.S. patent application Ser. No. 13/686,201 to Nakamura, now U.S. Pat. No. 8,628,402, filed Nov. 27, 2012, titled "Game Machine, Method of Controlling Computer, and Storage Medium", which is incorporated herein by reference in its entirety.

Figure 17:
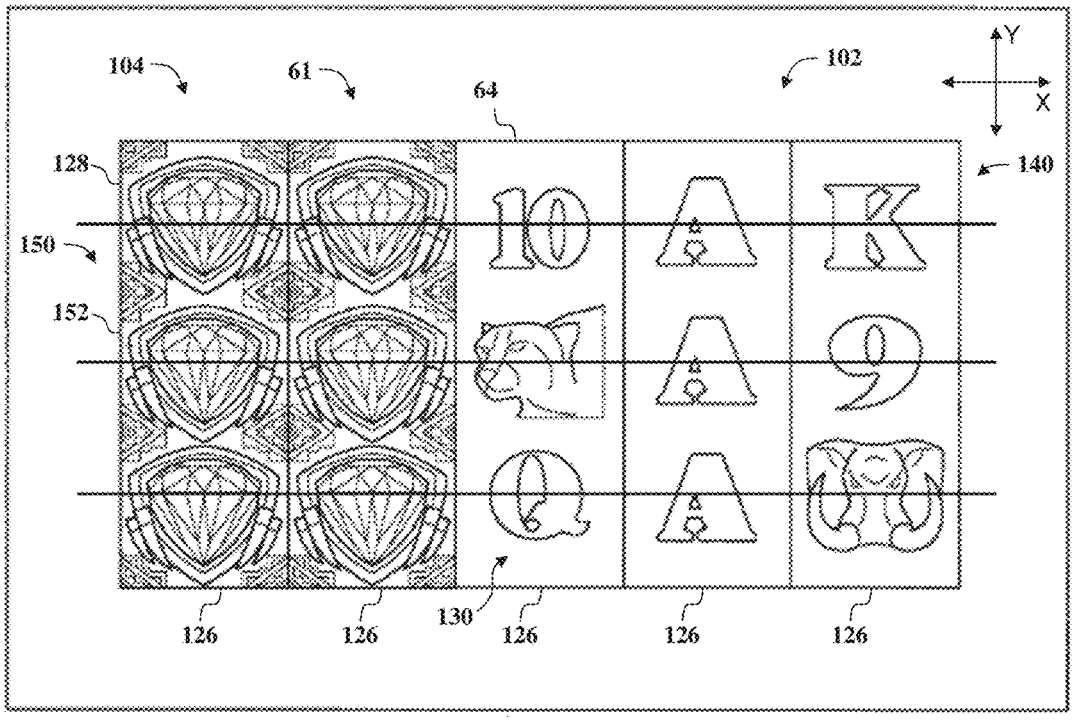
FIG. 17-20 are exemplary entertaining graphical display of a game screen including a slot-type game that may be displayed on the gaming machine shown in FIG. 1 during the method shown in FIG. 16, according to an embodiment of the present invention.

In one embodiment, as shown in FIGS. 4A-4B, and 17, the game symbol display effect 140 may include the appearance of a run 150 of consecutive symbol positions 128 that each include a similar game symbol 130. For example, during the game feature event 132, the symbol display unit 136 may display one or more reels 126 with one or more runs 150 of consecutive symbol positions 128. In addition, the symbol display unit 136 may randomly select a game symbol 130 from a predefined set of symbols, and display the selected game symbol 130 in each of the consecutive symbol positions 128 such that each of the consecutive symbol positions 128 displays the selected game symbol 130. In one embodiment, the symbol display unit 136 may select a plurality of similar symbols and/or a plurality of associated symbols such as, for example, a set of special symbols included in a category of special symbols, for display in each consecutive symbol position 128. For example, the predefined set of game symbols may include, but is not limited to, a category of symbols such as, for example, shapes, colors, sounds, items, characters, backgrounds, frames, and/or any category of game symbols that enable the gaming controller 106 to function as described herein. Each symbol category includes a plurality of symbols having predefined characteristics associated with the symbol category. For example, the predefined set of symbols may include a shape category that includes a plurality of symbols that each have a shape associated with the shape category. The symbol display unit 136 may select one or more symbols indicative of the shapes within the shape category, and display the selected symbols in each of the consecutive symbol positions 128. Additional details of adjacent special symbol positions, which may be used in the present invention, are described in U.S. patent application Ser. No. 11/299,009 to Yoshimi, now U.S. Pat. No. 8,096,869, filed Dec. 9, 2005, titled "Gaming Machine with Runs of Consecutive Identical Symbols", which is incorporated herein by reference in its entirety.

Figure 18:
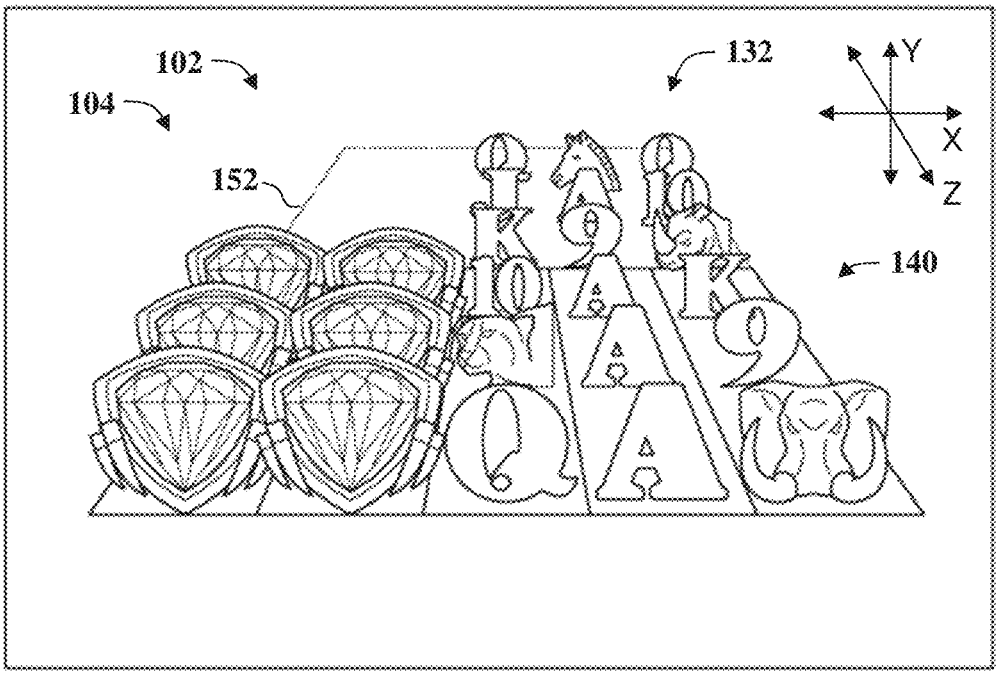
Figure 19:
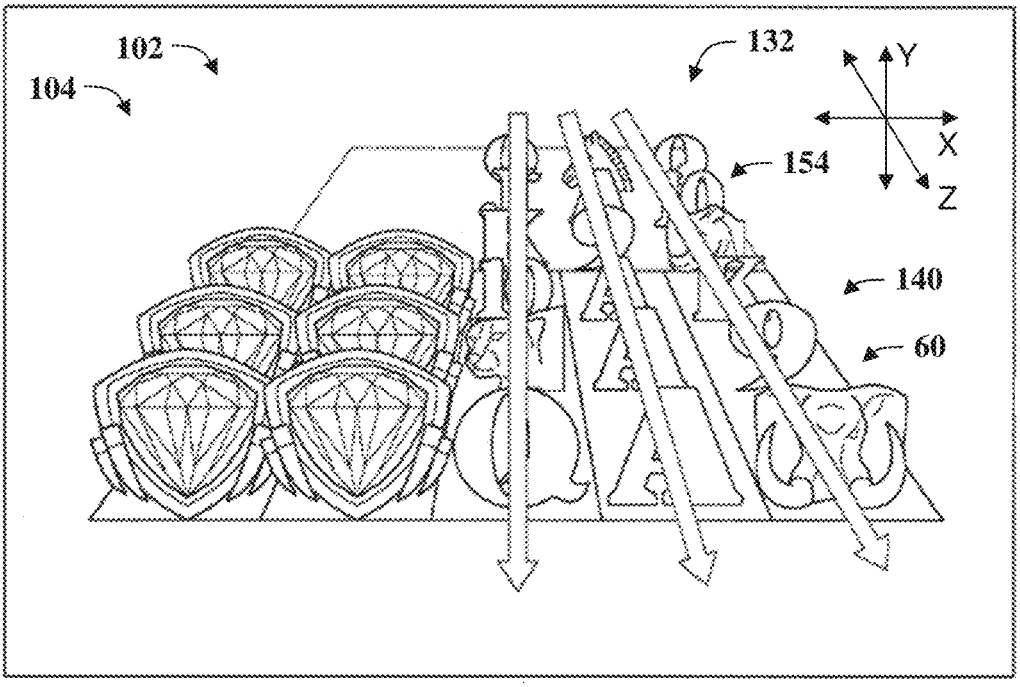

In one embodiment, the game symbol display effect 140 may include a game screen transition from a 2-Dimensional game screen (for example, a screen that provides a regular game displayed in a 2-D coordinate plane, as shown in FIG. 17) to a 3-Dimensional game screen (for example, a screen that provides a special game displayed in a 3-Dimensional coordinate plane as shown in FIGS. 18-19). For example, as shown in FIGS. 17-20, in one embodiment, the symbol display unit 136 may display the game 102 including a reel surface 152 being displayed in a 2-dimensional coordinate plane. The symbol display unit 136 transitions the game 102 to a 3D coordinate plane and tilts the reel surface 152 in a depth direction of the game screen, and the reel surface 152 stops only when the reel surface 152 is in a tilted position of a fixed angle θ (0°<θ<) 90°. In this situation, regardless of the angle of the reel surface 152, the game symbols 130 maintain an angle facing the screen direction (−Z-axis direction) of the display unit 27. Further, when the reel surface 152 is tilted, the reel surface 152 and the game symbols 130 are displayed while reducing and corresponding to the perspective drawing method according to a position in their respective depth directions. In this way, by tilting the reel surface 152 in a depth direction of the game screen, continuity of the screen display is preserved when migrating from a two-dimensional game screen to a three-dimensional game screen, and a smooth screen display migration is carried out without an uncomfortable feeling for the player. Furthermore, by transitioning the screen in this way, the player can easily understand when there is a special game state.

Figure 20:
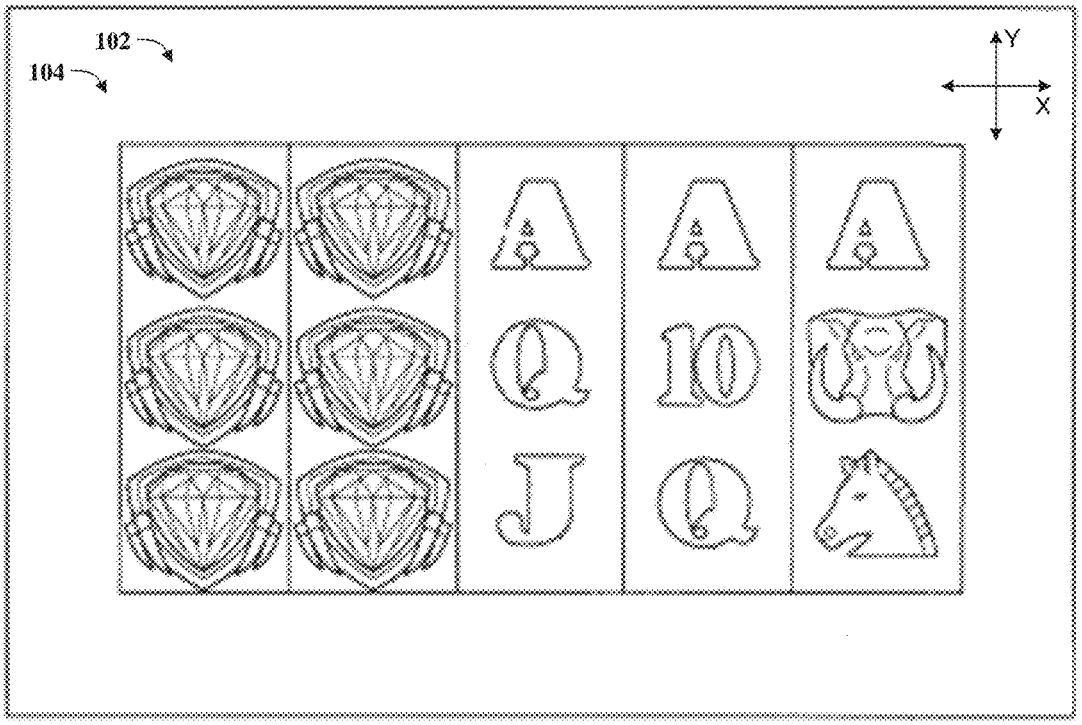

As shown in FIGS. 18 and 19, the determined area 60 displays the column in a state extending in a depth direction of a game screen in a three-dimensional screen. The gaming controller 106 displays the symbols 130 on the display unit 27 inside a virtual three-dimensional space where a column of the determined area 60 extends in a depth direction of the game screen. The gaming controller 106 moves and stops a plurality of symbols 130 along a direction of a column, aligned so that the column is configured along the plurality of symbols in a depth direction. In addition, the gaming controller 106 determines the stop position randomly for each column and stops the movement of the symbols 130 at a determined position. When the symbols 130 are stopped, as shown in FIG. 20, the gaming controller 106 removes (does not display) all of the symbols 130 aligned in a non-determined area 154. By this, a symbol in the determined area 60, that is, the symbol 130 can be displayed in a state where the game result is easy to understand for the player, to display only the symbol 130 relating to the game result. The gaming controller 106 then carries out a migration process from a three-dimensional game screen to a two-dimensional game screen. As shown in FIG. 20 the gaming controller 106 returns the reel surface 152 to the previous state and raises the stopped reel surface 152 to the front side in an inclined position of a fixed angle θ (0°<θ<90°) from a depth direction of the game screen, and the reel surface 152 returns to a flat state against the game screen. Additional details of 3-Dimensional game screens, which may be used in the present invention, are described in U.S. patent application Ser. No. 14/845,038 to Shiraishi, filed Sep. 3, 2015, titled "Gaming Machine, Control Method for Machine, and Program for Gaming Machine", which is incorporated herein by reference in its entirety.

Figure 21:
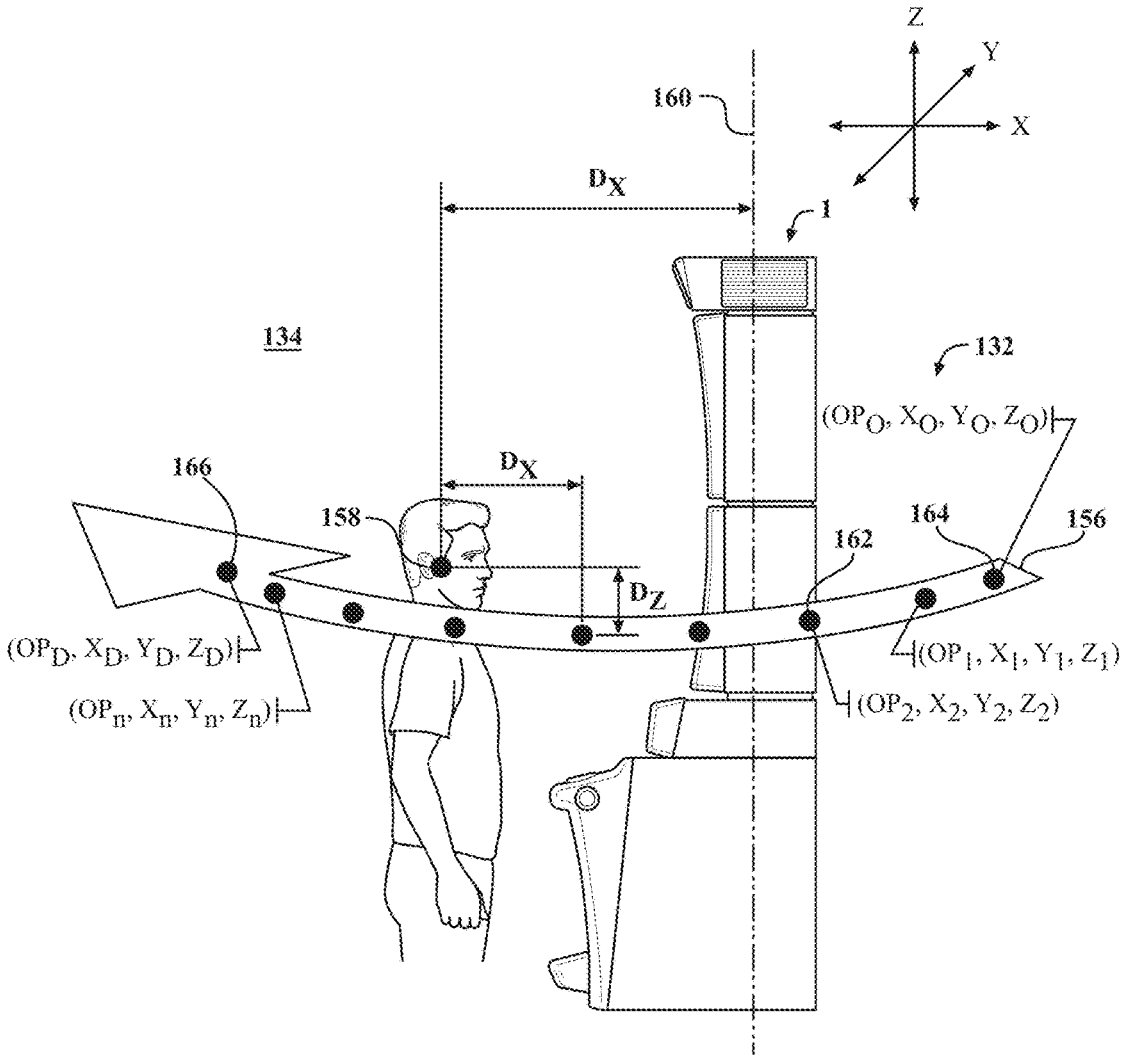
Figure 22:
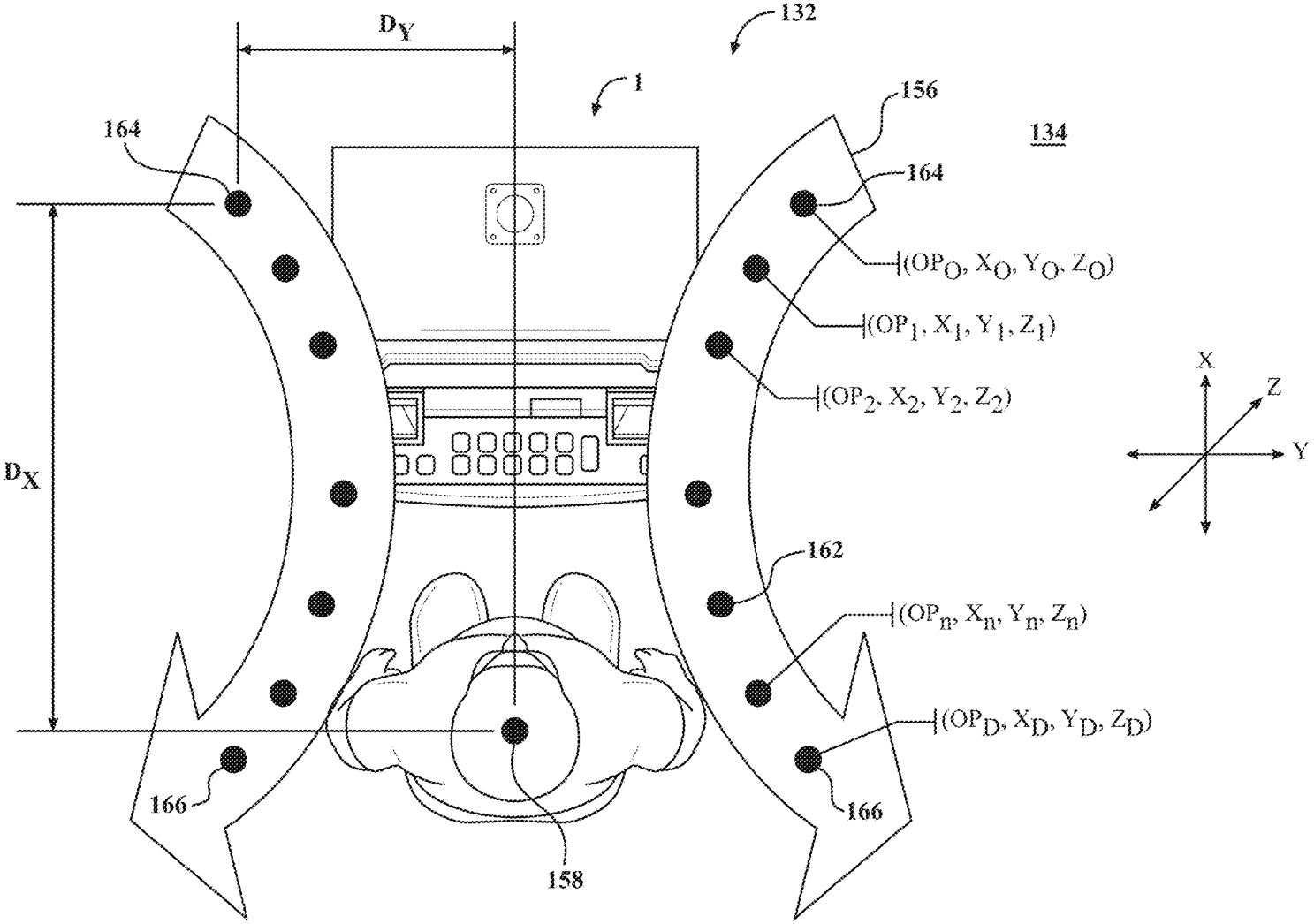

The sound feature unit 138 is configured to generate a sound feature within the gaming machine listening space 134 that includes 3D game sounds. In the illustrated embodiment, the sound feature unit 138 causes the sound reproduction system to emit a sound feature that includes one or more 3D sound effects traveling along one or more sound paths, represented by arrow 156 shown in FIGS. 7-10 and 21-26. Each sound path 156 is orientated with respect to a listening reference point 158 that is defined within the listening space 134. The sound reproduction system emits the sound feature to facilitate simulating a game symbol moving within the listening space 134. The listening space 134 includes the 3-dimensional area around the gaming machine 1. The three perpendicular axes X, Y, and Z extend through gaming machine 1, and are used to define a three-dimensional Cartesian coordinate system relative to gaming machine 1. Specifically, the Y-axis is oriented to extend substantially parallel with a front surface of the gaming machine 1, the X-axis is oriented to extend substantially perpendicular to the Y-axis, and the Z-axis is oriented substantially perpendicular to the X-axis and the Y axis. As shown in FIGS. 21 and 22, the listening reference point 158 indicates a relative position of a player with respect to the gaming machine 1 when the player is playing the gaming machine 1. The listening reference point 158 is orientate a distance, $D_x$, from a centerline 160 of the gaming machine 1 along the X-axis, and is spaced a distance along the Z-axis from the ground surface (not shown).

In the illustrated embodiment, the sound feature unit 138 generates the sound feature including a plurality of source locations 162 defined within the listening space 134 to form the sound path 156. Each source location 162 includes a 3-dimensional coordinate point defined within the listening space 134 including a X-axis value, a Y-axis value, and a Z-axis value. In one embodiment, each source location coordinate point is defined with respect to the listening reference point 158 and is position within the listening space 134 a distance $D_x$ from the listening reference point 158 along the X-axis, a distance $D_y$ from the listening reference point 158 along the Y-axis, and is spaced a distance $D_z$, from the listening reference point 158 along the Z-axis. In the illustrated embodiment, the sound path 156 includes an origination location 164 and a destination location 166.

During the game feature event 132, the sound feature unit 138 causes the sound reproduction system 35 to emit one or more 3D sound effects at each source location 162 along the sound path 156 to simulate the 3D sound effect moving along the sound path 156. The 3D sound effect may be generating with a specific volume at each source location 162 to facilitate simulating movement of the sound effect within the listening space 134. In addition, the sound feature may be generated to simulate the 3D sound effect occurring at each of the source locations 162 at a corresponding timing. For example, as shown in FIG. 21, the sound feature unit 138 may cause the sound reproduction system 35 to generate a sound feature that simulates a sound effect originating a position behind the gaming machine 1 and moving towards and past the player. In addition, the sound reproduction system 35 may also generate 3-dimensional ambient game sounds within the listening space 134 and generate the 3D sound effect such that the 3D sound effect is audibly distinguishable from the 3D ambient game sounds.

In one embodiment, a list of game feature records 168 (shown in FIG. 27), may be stored in the database 54. Each game feature record 168 may include data associated with a plurality of game feature events 132 that may be used during play of the game 102. For example, each game feature record 168 may include data associated with a 3D sound effect 170, a corresponding sound path 156, and a corresponding game symbol display effect 140. The database may also include a list of sound feature records 172 that include data for use in generating the 3D sound effect.

For example, as shown in FIG. 28, in one embodiment, a sound feature record 172 may include a plurality of source location records 174. Each source location record 174 may include a source location 162, coordinate points 176, a time interval 178, a frequency 180, and a decibel level 182 associated with the sound feature. During operation, the gaming controller 106 may select a game feature record from the list of game features records and select a corresponding sound feature record from the database 54. The sound feature unit 138 may generate signal data indicative of the selected sound feature as a function of the corresponding sound feature record 172. The signal data may include, for example, data associated with the 3D sound effect including the source locations 162 positioned along the sound path, a frequency and decibel level associated with each source location, and a time interval corresponding with each source location. The sound feature unit 138 may use the signal data to cause the sound reproduction system 35 to emit a 3-dimensional sound signal within the listening space that simulates the 3D sound effect originating at each source location at each corresponding time period to simulate the 3D sound effect moving within the listening space 134 along the corresponding sound path 156.

In the illustrated embodiment, the game feature module 124 detects a triggering condition occurring with the game 102 and initiates the game feature event 132 in response to detecting the triggering condition. In one embodiment, the triggering condition may be a mystery trigger condition that may occur after any bought game and/or any game outcome initiated based on a wager received from the player. For example, in one embodiment, the gaming controller 106 may randomly select a game feature event number from a predefined range of numbers. Upon receiving a wager from the player, the gaming controller 106 may also randomly select a primary game number from the predefined range of numbers and initiate the game feature event if the primary game number matches the game feature event number. At the completion of the game feature event, the gaming controller 106 randomly selects another game feature event number from the predefined set of numbers for use in initiating a subsequent game feature event. If the primary game number does not match the game feature event number, the gaming controller 106 randomly selects another primary game number when another wager is received from the player.

In another embodiment, the gaming controller 106 may detect the triggering condition based on the appearance of one or more predefined game symbols, for example a scatter symbol, and/or a predefined combination of game symbols appearing in one or more game outcomes. In addition, the triggering condition may be detected as a function of the amount of a current wager, a cumulative amount of wagers placed by the player, a level of play, player ranking, and/or any suitable triggering condition that enables the gaming controller 106 to function as described herein.

Figure 16:
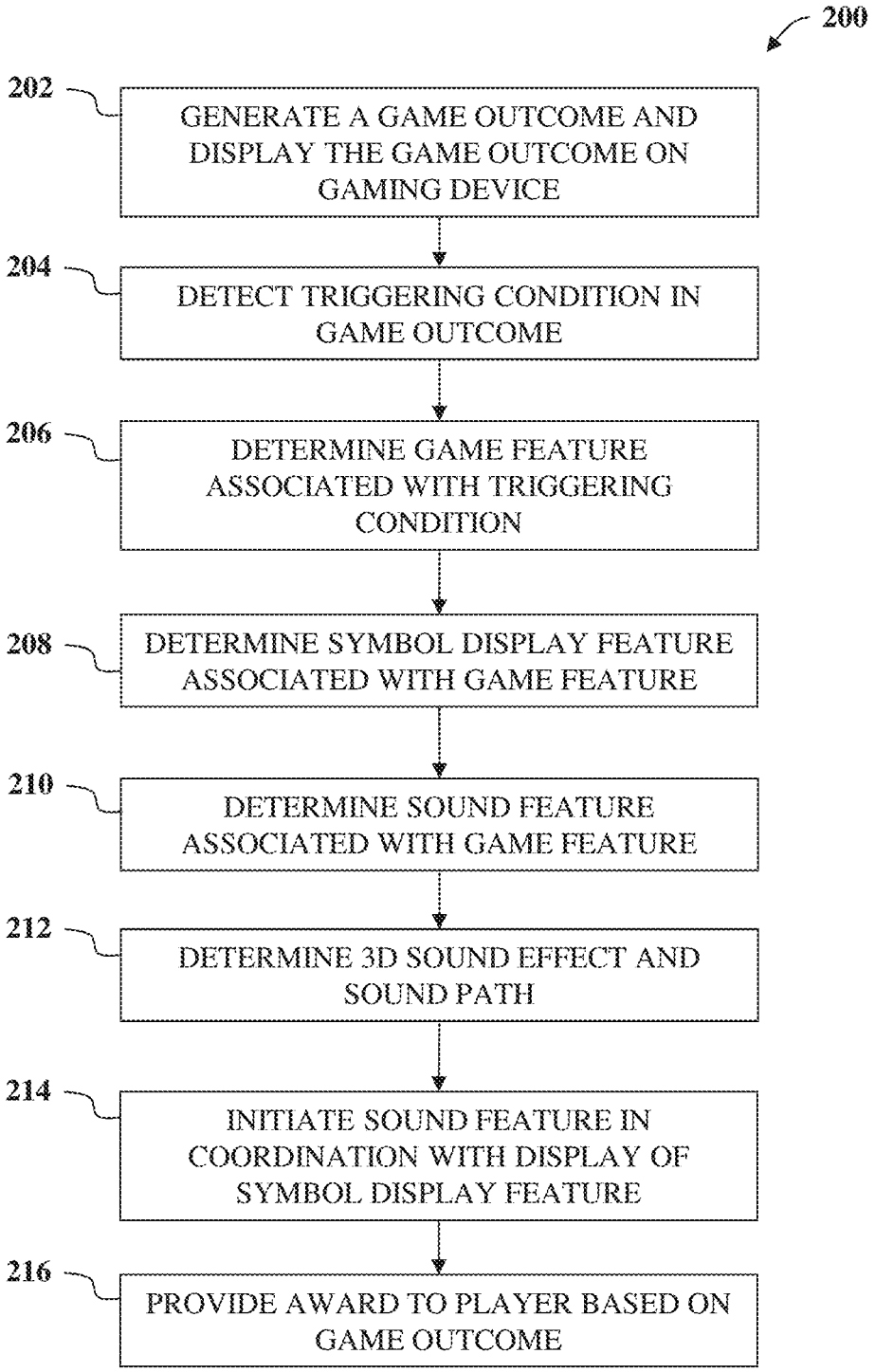
FIG. 16 is a flowchart of a method that may be used with the gaming device shown in FIG. 1 for providing a game to a player, according to an embodiment of the present invention.

FIG. 16 is a flowchart of a method 200 that may be used with the gaming machine 1 to provide an award to a player.

The method 200 includes a plurality of steps. Each method step may be performed independently of, or in combination with, other method steps. Portions of the method 200 may be performed by any one of, or any combination of, the components of one or more gaming machines 1. FIGS. 6A-6D and 17-20 are exemplary entertaining graphical display of a game screen 104 including a slot-type game 102 that may be displayed on the gaming machine 1 during the method 200, according to an embodiment of the present invention.

In the illustrated embodiment, in method step 202, the gaming controller 106 receives a signal indicative of a wager being received by the gaming machine 1 and responsively displays the game 102 on the display device 27. In one embodiment, the game 102 is a video slot game. However, it should be noted that the game 102 may be any type of game upon which a player could make a wager including, but not limited to a keno game, a blackjack game, a video poker game, or any type of game that enables the gaming controller 106 to function as described herein. In addition, in one embodiment, the game 102 may include a slot game being displayed with a plurality of mechanical reels (not shown). In the illustrated embodiment, the gaming controller 106 displays the game 102 on the first display 26. In another embodiment, the gaming controller 106 displays the game 102 on the first display 26 and/or the second display 21.

In method step 202, the gaming controller 106 randomly generates an outcome of the game 102 and displays the generated game outcome in the game screen 104. In one embodiment, the gaming controller 106 randomly selects a plurality of game symbols 130 from a predefined set of possible game symbols, and displays the selected game symbols 130 associated with the generated game outcome in the game screen 104. In another embodiment, the gaming controller 106 randomly selects a stop position associated with each reel 126, and spins and stops each of the reels 126 based on the corresponding stop position, and determines the game outcome based on the symbols 130 being displayed with the reels in a stopped position.

In the illustrated embodiment, the plurality of game symbols 130 are displayed in a display area 61 that includes a grid having a plurality of cells 64 arranged along a plurality of rows and a plurality of columns. Each cell 64 displays one or more game symbols 130 associated with the game outcome. In the illustrated embodiment, the gaming controller 106 displays the game 102 including a plurality of reels 126. Each reel 126 includes a plurality of symbol positions 128 that each displays a game symbol 130. In one embodiment, the gaming controller 106 may display the game including 5 reels 126 each with 3 cells 64 per reel 126, respectively (a "5×3" arrangement). In addition, other reel arrangements may be used such as, for example, 3-4-3-4-3, 4-5-5-5-4, or 4-5-4-5-4 arrangements or arrangements with the same number of cells per column, such as 3×3, 3×4, 4×5, or 5×5 configurations. The game 102 may also include a plurality of paylines that extend across one or more cells 64 to indicate, to the player, a combination of game symbols 130.

In the illustrated embodiment, the gaming controller 106 receives a signal, from the user input device, that is indicative of a player's selection to initiate a gaming session including a wager amount, and a selection of one or more paylines associated with a predefined set of cells 64 within the display area 61. In the illustrated embodiment, the game 102 is a multi-line game, i.e., the paylines include horizontal paylines and/or diagonal pay-lines, and/or zig-zag paylines. Moreover, the user input device may allow the player to toggle to increase the bet per payline a credit at a time (up to the maximum bet). The gaming controller 106 randomly generates an outcome of the game 102, and displays the generated outcome on the game screen 104. In one embodiment, the gaming controller 106 is configured to rotate, and/or spin each reel 126 to initiate a game play, and stop each reel 126 to display a plurality of game symbols 130 associated with the randomly generated outcome. In addition, the gaming controller 106 is adapted to determine if the generated outcome is a winning outcome as a function of the displayed game symbols 130, a paytable, a wager, and one or more player selected paylines. More specifically, the gaming controller 106 determines if a combination of symbols 130 arranged along the selected payline is a winning combination. The gaming controller 106 may provide an award in response to the outcome of the game 102.

Each game 102 is generally played in a conventional manner. The player makes a wager, which may be based on a predetermined denomination and a selected number of paylines, the gaming controller 106 randomly generates an outcome for the game 102, spins the reels 126, and selectively stops the reels 126 to display a game symbol 130 in each of the display cells 64. If a predetermined pattern of game symbols 130 is randomly chosen for each cell 64 on a played payline, the player may be awarded a payout based on the payline, the wager, and a predetermined paytable. Moreover, the player may be awarded a payout if the combination of game symbols 130 associated with a selected payline is a winning combination. In addition, a player may receive a bonus feature, bonus games, and/or free games based on the combination of game symbols 130 associated with the selected payline and/or the appearance of one or more special game symbols in the game outcome. Many variations to the above described general play of a slot game fall within the scope of the present invention. Such slot games are well-known in the art, and are therefore not further discussed.

In method step 204, the gaming controller 106 detects the occurrence of a triggering condition during the game 102 and initiates the game feature event 132 (shown in FIGS. 6-10 and 17-26) in response to detecting the triggering condition. In the illustrated embodiment, the triggering condition is mystery trigger condition that may be detected after any game outcome. The gaming controller 106 may randomly select a game feature event number from a predefined range of numbers and, upon receiving a wager from the player, the gaming controller 106 randomly selects a game number and detects the triggering condition if the primary game number matches the game feature event number. In one embodiment, the triggering condition may be a game symbol and/or set of game symbols appearing during game play.

In method step 206, upon detecting the triggering condition, the gaming controller 106 responsively determines a game feature event associated with the triggering condition. In one embodiment, the gaming controller 106 may select a game feature record 168 from the list of game feature records being stored in the database 54 as a function of the triggering condition. For example, the database may include a list of triggering events such as, for example, a scatter symbol appearance, a wager amount, and/or a mystery trigger, and a corresponding game feature event associated with each triggering condition. The gaming controller 106 may determine the triggering condition being detected during the game and select a corresponding game feature event 132. In another embodiment, the gaming controller 106 may randomly select a game feature event from use during game play.

In method step 208, the gaming controller 106 determines the symbol display feature associated with the game feature event 132. For example, in one embodiment, the gaming controller 106 may select a game feature event record from the database 54 and determine the symbol display feature associated with the selected game feature event record.

In method step 210, the gaming controller 106 determines the sound feature associated with the game feature event 132. For example, in one embodiment, the gaming controller 106 may select a game feature event record from the database 54 and determine the sound feature associated with the selected game feature event record.

In method step 212, the gaming controller 106 determines one or more 3D sound effects associated with the selected sound feature and determines one or more sound paths associated with the 3D sound effects. In one embodiment, the gaming controller 106 accesses the database to select a sound feature record 172 from the list of sound feature records 172, and determines the number of source locations 162, coordinate points, sound frequency data, and decibel levels associated with the corresponding sound paths and 3D sound effects.

In method step 214, the gaming controller 106 initiates the game feature event 132 during game play including generating the sound feature in coordination with the display of the symbol display feature. More specifically, in the illustrated embodiment, the gaming controller 106 coordinates the display of the symbol display event being displayed in the display device 27 with the 3D sound feature being generated by the sound reproduction system 35 to simulate game elements moving within the listening space 134. For example, in one embodiment, the gaming controller 106 generates the game feature including a game symbol display effect including a game symbol 130 being displayed within the display area and causes the sound reproduction system 35 to emit the sound feature in coordination with the game symbol display effect. In one embodiment, the gaming controller 106 causes the sound reproduction system 35 to initiate the sound feature before the game symbol 130 is displayed within the display area to facilitate increasing the player's expectation of the game symbol. For example, the game symbol display effect 140 may include a run of consecutive identical symbols being displayed in one of the reels 126. The sound reproduction system 35 may be configured to generate the 3D sound effect in coordination with the run of consecutive identical symbols to simulate the run of consecutive identical symbols 130 being moved toward the player as the run of consecutive identical symbols 130 is being spun through the grid, as shown in FIGS. 17-20.

In one embodiment, the game symbol display effect may include a bonus symbol reel 126 (shown in FIGS. 6A-6D) appearing on the display device 27 and being moved along a symbol display path. The sound reproduction system 35 may be configured to generate the 3D sound effect in coordination with the display of the bonus symbol reel 126 to simulate the bonus symbol reel being moved around a perimeter of the player (shown in FIGS. 8-10).

Figure 25:
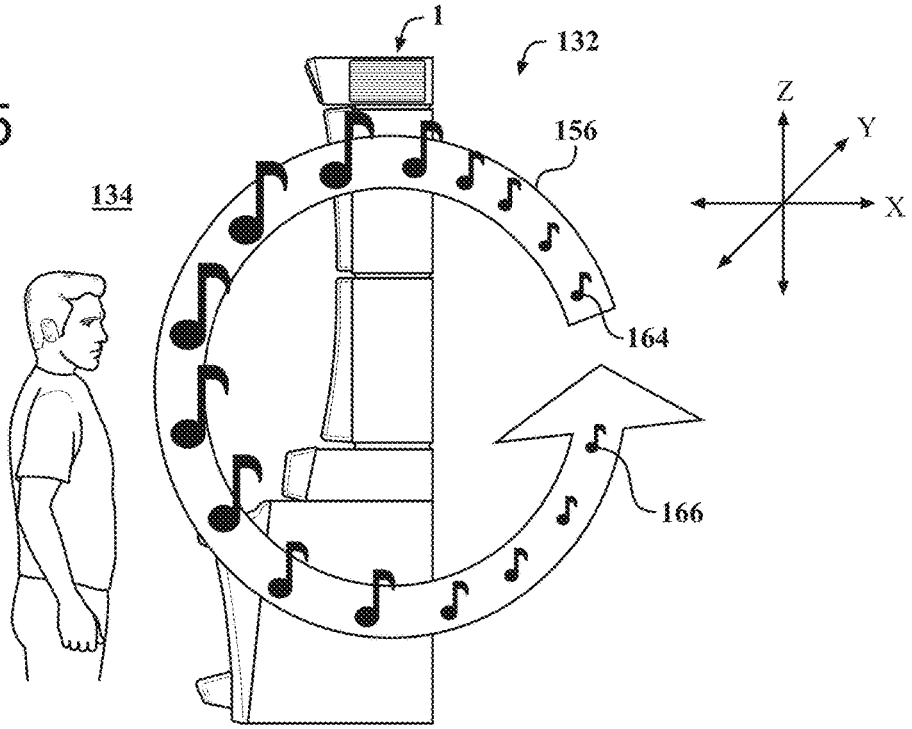
Figure 26:
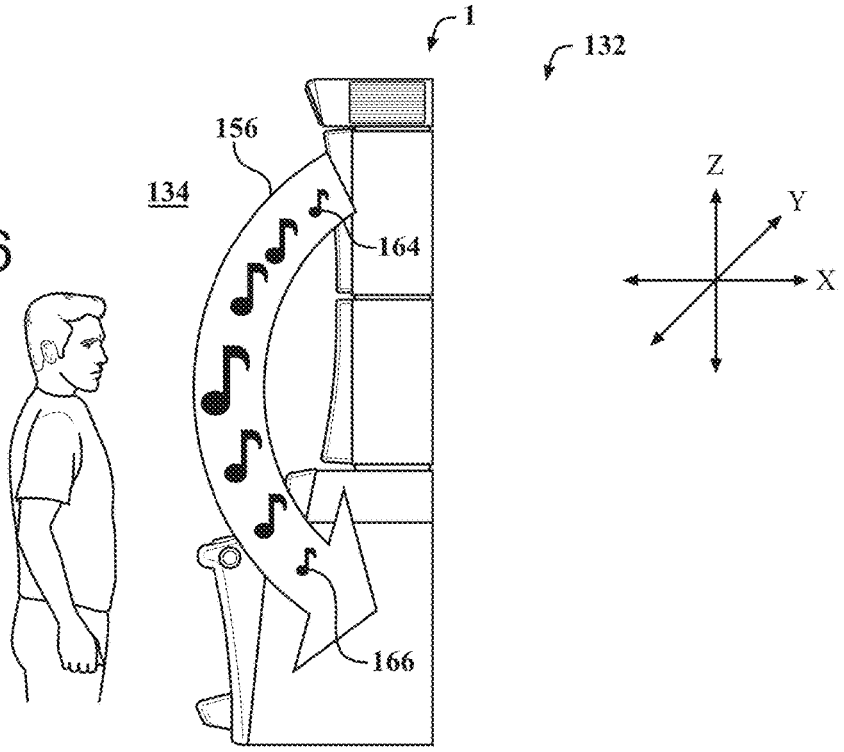

As shown in FIGS. 21-24, in one embodiment, the sound reproduction system 35 is configured to generate the sound path 156 including the origination location 164 orientated at a location with respect to a rear portion of the housing 10 such that the gaming machine 1 is positioned between the origination location 164 and the listening reference point 158. In another embodiment, as shown in FIG. 22, the sound reproduction system 35 may generate the sound path 156 including the origination location 164 and the destination location 166 being orientated adjacent to the housing 10. In addition, as shown in FIGS. 25-26, the sound reproduction system 35 may generate the sound path 156 having a substantially elliptical shape having a centerline being defined by the listening reference point 158. The sound reproduction system 35 may also generate the sound feature including the 3D sound effect having a varying volume level along the sound path 156.

In one embodiment, as shown in FIGS. 17-20, the game symbol display effect may include symbols being displayed in virtual 3D space during free game. In the virtual 3D space, symbols move from backward to forward instead of conventional reel spin. During play of the game, when stacked symbols, e.g. a run of consecutive similar symbols, are approaching a forward position during symbol movement, additional 3D sound effects accompanied with the stacked symbols is provided. The additional sound effect is performed with moving sound localization in 3D sound space, as shown in FIGS. 23-26 illustrating the moving sound path of the sound localization with the size of musical notes indicating the volume of the sound effect. When the stacked symbols are appearing on left side reels (reel 1 or 2), the gaming machine 1 starts to provide its sound effect in low volume with its sound localization in left side of gaming machine 1. As the symbols move, the sound localization of the sound effect moves on the moving path and the volume is increased. When the stacked symbols appear on display, the volume of the sound effect is increased according to location of the symbol in the virtual 3D space. After stacked symbols passing the display area, the sound location of the sound effect passes side of player and the volume of the sound effect is decreased gradually. When the stacked symbols are appearing on right side reels (reel 4 or 5), the gaming machine 1 starts sound effect with its sound localization in right side of gaming machine 1. When the stacked symbols are appearing on center reel (reel 3), the gaming machine 1 starts sound effect with its sound localization in backside of gaming machine 1.

In addition, the 3D sound functionality is applicable to gaming machine 1 using conventional rotating reels. In one embodiment, as shown in FIGS. 17 and 22, the sound localization of the sound effect follow the stacked symbol position in the display. The sound localization of the sound effect may also follows the stacked symbol position in the rotating reel. The 3D sound effect may also be associated with wild symbols, scatter symbols, bonus symbols or multiplier symbols etc. In addition, action stacked symbols is used in the game, the 3D sound effect may be changed in accordance with substantial symbol displayed in the action stacked symbols. For example, if the stacked symbols display a lion, the 3D sound effect simulates a lions' roar; if the stacked symbols display birds, the 3D sound effect simulates the sound of birds; if the stacked symbols display coins, the 3D sound effect simulates a jingle of coins, and the like.

The above-described systems and methods overcome at least some disadvantages of known gaming machines by providing a gaming machine that includes a sound system configured to generate and emit a 3D sound effect. More specifically, the gaming machine is configured to display a game feature that includes a symbol display effect and a 3D sound effect that is generated in coordination with the display effect to simulate a game element being moved throughout a listening space defined around the gaming machine. By providing a 3D sound feature associated with a game feature, the player's expectation for achieving a win is increased, and the enjoyment of the game is improved. Thus, the amount of time that the game is played by patrons of a gaming establishment is thereby increased.

Exemplary embodiments of a gaming machine, a gaming system, and a method of providing a game to a player with a gaming machine are described above in detail. The gaming machine, systems, and methods are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game to a player, including:

a housing;

a sound reproduction system coupled to the housing and configured to generate sound features associated with the game, the sound reproduction system configured to emit 3-Dimensional (3D) sound effects within a listening space associated with the gaming machine;

a display device for displaying the game to a player, the game including a plurality of reels being displayed in a display area;

a memory device storing a plurality of game feature records associated with a plurality of game features, each game feature record including 3D sound effect data and symbol display data, the 3D sound effect data including instructions for emitting a plurality of audible signals to generate a 3D sound effect traveling along a sound path including a plurality of source locations, each audible signal including a corresponding source location including a 3D coordinate point defined within the listening space, a volume level, a frequency level, and a predefined time interval;

a gaming controller configured to:

allow the player to make a wager on the game and adjust the credit balance by an amount of the wager;

randomly determine an outcome of the game and display the outcome on the display device, the game including a plurality of reels being displayed on the display device;

detect a triggering condition occurring in the outcome of the game; and determine a game feature in response to detecting the triggering condition, the game feature including a game element moving through the display area;

select a game feature record associated with the determined game feature from the plurality of game feature records stored in the memory device;

identify a listening reference point including a 3D coordinate defined within the listening space, the listening reference point indicating an approximate position of a player with respect to the gaming machine;

generate 3D sound data associated with the game feature using the 3D sound effect data included in the selected game feature record, the 3D sound data including the plurality of source locations defined along the sound path orientated with respect to the listening reference point;

operate the display device to display the game element associated with the determined game feature using symbol display data included in the selected game feature record; and operate the sound reproduction system as a function of the 3D sound data and cause the sound reproduction system to generate a sound feature including a 3D sound effect traveling along the sound path to facilitate simulating the game element moving within the listening space.

2. A gaming machine in accordance with claim 1, the sound reproduction system generating 3D ambient game sounds within the listening space, the 3D sound effect being audibly distinguishable from the 3D ambient game sounds.

3. A gaming machine in accordance with claim 1, wherein the plurality of source locations includes an origination location including a 3D coordinate positioned at a rear of the gaming machine.

4. A gaming machine in accordance with claim 1, wherein each source location includes a signal frequency and a decibel level.

5. A gaming machine in accordance with claim 1, the game feature including a game symbol display effect including a game symbol being displayed by the display device, the sound reproduction system generating the sound feature in coordination with the game symbol display effect.

6. A gaming machine in accordance with claim 5, the game symbol display effect including a consecutive run of identical symbols being displayed in one of the reels of the plurality of reels, the sound reproduction system generating the 3D sound effect in coordination with the consecutive run of identical symbols.

7. A gaming machine in accordance with claim 5, the game symbol display effect including a bonus symbol reel appearing on the display device and being moved along a symbol display path, the sound reproduction system generating the 3D sound effect in coordination with the display of the bonus symbol reel.

8. A computer-implement method for providing a game to a player with a gaming machine including a housing, a sound reproduction system, a display device, and a gaming controller, the method including the steps of:

allowing the player, through the acceptor device, to make a wager on the game and adjust the credit balance by an amount of the wager;

randomly determining, by the gaming controller, an outcome of the game and display the outcome on the display device, the game including a plurality of reels being displayed on the display device;

detecting, by the gaming controller, a triggering condition occurring in the outcome of the game;

determining, by the gaming controller, a game feature in response to detecting the triggering condition, the game feature including a game element moving through the display area;

accessing a memory device storing a plurality of game feature records associated with a plurality of game features, each game feature record including 3D sound effect data and symbol display data, the 3D sound effect data including instructions for emitting a plurality of audible signals to generate a 3D sound effect traveling along a sound path including a plurality of source locations, each audible signal including a corresponding source location including a 3D coordinate point defined within the listening space, a volume level, a frequency level, and a predefined time interval;

selecting a game feature record associated with the determined game feature from the plurality of game feature records stored in the memory device;

identifying a listening reference point including a 3D coordinate defined within the listening space, the listening reference point indicating an approximate position of a player with respect to the gaming machine;

generating 3D sound data associated with the game feature using the 3D sound effect data included in the selected game feature record, the 3D sound data including the plurality of source locations defined along the sound path orientated with respect to the listening reference point;

operating the display device to display the game element associated with the determined game feature using symbol display data included in the selected game feature record; and operating the sound reproduction system as a function of the 3D sound data to cause the sound reproduction system to generate a sound feature including a 3D sound effect traveling along the sound path to facilitate simulating the game element moving within the listening space.

9. A computer-implemented method in accordance with claim 8, including the steps of generating 3D ambient game sounds within the listening space, the 3D sound effect being audibly distinguishable from the 3D ambient game sounds.

10. A computer-implemented method in accordance with claim 8, wherein the plurality of source locations includes an origination location including a 3D coordinate positioned at a rear of the gaming machine.

11. A computer-implemented method in accordance with claim 8, wherein each source location includes a signal frequency and a decibel level.

12. A computer-implemented method in accordance with claim 8, including the steps of:

determining a game symbol display effect associated with the game feature and displaying the game symbol display effect including a game symbol being displayed by the display device; and generating the sound feature in coordination with the game symbol display effect.

13. A computer-implemented method in accordance with claim 12, the game symbol display effect including a consecutive run of identical symbols being displayed in one of the reels of the plurality of reels, the sound reproduction system generating the 3D sound effect in coordination with the consecutive run of identical symbols.

14. A computer-implemented method in accordance with claim 12, the game symbol display effect including a bonus symbol reel appearing within the display area and being moved along a symbol display path, the sound reproduction system generating the 3D sound effect in coordination with the display of the bonus symbol reel.

15. One or more non-transitory computer-readable storage media, having computer-executable instructions embodied thereon, wherein when executed by at least one processor, the computer-executable instructions cause the processor:

receive a signal indicating a wager being placed by a player on a game and adjust a credit balance associated with the player by an amount of the wager;

randomly determine an outcome of the game and display the outcome on a display device, the game including a plurality of reels being displayed on the display device;

detect a triggering condition occurring in the outcome of the game; and determine a game feature in response to detecting the triggering condition, the game feature including a game element moving through the display area;

access a memory device storing a plurality of game feature records associated with a plurality of game features, each game feature record including 3D sound effect data and symbol display data, the 3D sound effect data including instructions for emitting a plurality of audible signals to generate a 3D sound effect traveling along a sound path including a plurality of source locations, each audible signal including a corresponding source location including a 3D coordinate point defined within the listening space, a volume level, a frequency level, and a predefined time interval;

select a game feature record associated with the determined game feature from the plurality of game feature records stored in the memory device;

identify a listening reference point including a 3D coordinate defined within the listening space, the listening reference point indicating an approximate position of a player with respect to the gaming machine;

generate 3D sound data associated with the game feature using the 3D sound effect data included in the selected game feature record, the 3D sound data including the plurality of source locations defined along the sound path orientated with respect to the listening reference point; and operate the display device to display the game element associated with the determined game feature using symbol display data included in the selected game feature record;

operate the sound reproduction system as a function of the 3D sound data to cause a sound reproduction system to generate a sound feature, the sound reproduction system being coupled to a gaming machine housing and configured to generate 3D sound effects within a listening space associated with the gaming machine, the sound feature including a 3D sound effect traveling along the sound path to facilitate simulating the game element moving within the listening space.

16. The one or more computer-readable storage media according to claim 15, the computer-executable instructions cause the processor to generate 3D ambient game sounds within the listening space, the 3D sound effect being audibly distinguishable from the 3D ambient game sounds.

17. The one or more computer-readable storage media according to claim 15, wherein the plurality of source locations includes an origination location including a 3D coordinate positioned at a rear of the gaming machine.

18. The one or more computer-readable storage media according to claim 15, the computer-executable instructions cause the processor to:

generate a game symbol display effect associated with the game feature, the game symbol effect including a game symbol being displayed by the display device; and generate the sound feature in coordination with the game symbol display effect.

19. The one or more computer-readable storage media according to claim 18, the computer-executable instructions cause the processor to:

generate the game symbol display effect including a consecutive run of identical symbols being displayed in one of the reels of the plurality of reels; and generate the 3D sound effect in coordination with the consecutive run of identical symbols.

20. The one or more computer-readable storage media according to claim 18, the computer-executable instructions cause the processor to:

generate the game symbol display effect including a bonus symbol reel appearing on the display device and being moved along a symbol display path; and generate the 3D sound effect in coordination with the display of the bonus symbol reel.

* * * * *